US008602863B2

(12) United States Patent
Walker et al.

(10) Patent No.: US 8,602,863 B2
(45) **Date of Patent: *Dec. 10, 2013**

(54) METHOD AND APPARATUS FOR DETERMINING A GAME SERIES COMPRISING A PLURALITY OF INDIVIDUALLY SELECTABLE WAGERING GAMES

(71) Applicant: IGT, Reno, NV (US)

(72) Inventors: Jay S. Walker, Stamford, CT (US); Robert C. Tedesco, Trumbull, CT (US); James A. Jorasch, New York, NY (US); Daniel E. Tedesco, Shelton, CT (US); Stephen C. Tulley, Stamford, CT (US)

(73) Assignee: IGT, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/796,630

(22) Filed: Mar. 12, 2013

(65) Prior Publication Data

US 2013/0203484 A1 Aug. 8, 2013

Related U.S. Application Data

(63) Continuation of application No. 13/198,473, filed on Aug. 4, 2011, now Pat. No. 8,403,744, which is a continuation of application No. 11/336,245, filed on Jan. 20, 2006, now Pat. No. 8,016,657.

(51) Int. Cl.
*A63F 9/24* (2006.01)

(52) U.S. Cl.
USPC ..... 463/16; 463/20

(58) Field of Classification Search
USPC ..... 463/16, 20
See application file for complete search history.

(56) References Cited

U.S. PATENT DOCUMENTS

| | | | |
|---|---|---|---|
| 5,820,459 | A | 10/1998 | Acres et al. |
| 5,836,817 | A | 11/1998 | Acres et al. |
| 5,890,962 | A | 4/1999 | Takemoto |
| 5,947,820 | A | 9/1999 | Morro et al. |

(Continued)

FOREIGN PATENT DOCUMENTS

| | | | |
|---|---|---|---|
| EP | 0 655 265 | | 5/1995 |
| JP | 11-226264 | A | 8/1999 |

(Continued)

OTHER PUBLICATIONS

Letter from Reina Kakimoto of Mots Law dated Jan. 24, 2012 regarding Third Party Submission in Published Application Under 37 C.F. R. 1.99 filed for U.S. Appl. No. 13/198,473 (2 pages).

(Continued)

*Primary Examiner* — Corbett B Coburn
(74) *Attorney, Agent, or Firm* — Neal, Gerber & Eisenberg LLP

(57) ABSTRACT

A wagering method is provided that allows players or gaming establishments to specify conditions which when satisfied, reconfigure the gaming device to change game play from a first game to a second game. The condition may depend upon the value of a parameter—generally related to game play—to determine if the condition is valid and triggers the reconfiguration. The second game may be selected from a game on the same gaming device, from a game on a different gaming device, or a game played by a specific player.

24 Claims, 11 Drawing Sheets

(56) References Cited

U.S. PATENT DOCUMENTS

| | | | | |
|---|---|---|---|---|
| 5,951,397 | A | 9/1999 | Dickinson | |
| 6,047,963 | A | 4/2000 | Pierce et al. | |
| 6,159,095 | A | 12/2000 | Frohm et al. | |
| 6,244,958 | B1 | 6/2001 | Acres | |
| 6,254,483 | B1 | 7/2001 | Acres | |
| 6,312,334 | B1 * | 11/2001 | Yoseloff | 463/25 |
| 6,319,125 | B1 | 11/2001 | Acres | |
| 6,398,645 | B1 | 6/2002 | Yoseloff | |
| 6,565,437 | B2 | 5/2003 | Orui | |
| 6,648,758 | B2 | 11/2003 | Bennett et al. | |
| 6,652,378 | B2 | 11/2003 | Cannon et al. | |
| 6,656,040 | B1 | 12/2003 | Brosnan et al. | |
| 6,832,957 | B2 | 12/2004 | Falconer | |
| 6,837,788 | B2 | 1/2005 | Cannon | |
| 6,939,226 | B1 | 9/2005 | Joshi | |
| 6,960,136 | B2 | 11/2005 | Joshi et al. | |
| 2002/0077167 | A1 | 6/2002 | Merari | |
| 2002/0183105 | A1 | 12/2002 | Cannon et al. | |
| 2003/0060268 | A1 | 3/2003 | Falconer | |

FOREIGN PATENT DOCUMENTS

| | | |
|---|---|---|
| WO | WO 98/56475 | 12/1998 |
| WO | WO 99/10849 | 3/1999 |
| WO | WO 01/82245 | 11/2001 |
| WO | WO 02/099760 | 12/2002 |
| WO | WO 03/028830 | 4/2003 |
| WO | WO 03/041825 | 5/2003 |
| WO | WO 2005/079242 | 9/2005 |

OTHER PUBLICATIONS

Marshall Fey, Slot Machines, A Pictoral History of the First 100 Years, Liberty Belle Books, p. 162, Copyright 1983 (1 page).

Office Action for U.S. Appl. No. 11/456,163, dated May 7, 2008 (7 pages).

Office Action for U.S. Appl. No. 11/456,163, dated Nov. 2, 2007 (7 pages).

Partially highlighted JP 11-226264A and English translation of paragraphs [0007] and [0012] of same submitted with Third Party Submission in Published Application Under 37 C.F.R. 1.99 for U.S. Appl. No. 13/198,473, dated Jan. 24, 2012 (3 pages).

Partially highlighted U.S. Patent No. 6,565,437 submitted with Third Party Submission in Published Application Under 37 C.F.R. 1.99 for U.S. Appl. No. 13/198,473, dated Jan. 24, 2012 (1 page).

Third Party Submission in Published Application Under 37 C.F.R. 1.99 filed for U.S. Appl. No. 13/198,473, dated Jan. 24, 2012 (3 pages).

* cited by examiner

400

| PLAYER ID 410 | SOCIAL SECURITY NUMBER 412 | NAME 414 | ADDRESS 416 | PHONE NUMBER 418 | CREDIT CARD NUMBER 420 |
|---|---|---|---|---|---|
| 123456 | 123-45-7890 | BILL GREEN | 111 NORTH AVE. | (212) 555-1234 | 1111-2222-3333-4444 |
| 876543 | 876-54-3210 | ROB BLUE | 423 SOUTH ST. | (812) 555-4321 | 2222-4444-6666-8888 |
| 158595 | 555-12-6338 | KAREN RED | 64 WEST RD. | (315) 555-5954 | 1111-3333-5555-7777 |

| CREDIT BALANCE 422 | (ACCUMULATED) COMP. POINTS 424 | HOTEL GUEST 426 | PLAYER RATING 428 |
|---|---|---|---|
| $25.00 | 130 PTS. | NO | 4 |
| $17.50 | 240 PTS. | YES | 2 |
| $0.00 | 350 PTS. | YES | 2 |

FIG. 4

600

| PARAMETER 602 | GAME A 610 | GAME B 610 | GAME C 610 | GAME D 610 | GAME E 610 |
|---|---|---|---|---|---|
| CONSECUTIVE WINS | 2 | 4 | 6 | 1 | 2 |
| CONSECUTIVE LOSSES | 5 | 25 | 30 | 5 | 25 |
| TOP PAYOUT IN THE LAST HOUR | 50 CREDITS | 30 CREDITS | 25 CREDITS | 30 CREDITS | 45 CREDITS |
| LEAST PAYOUT IN THE LAST HOUR | 5 CREDITS | 5 CREDITS | 25 CREDITS | 15 CREDITS | 30 CREDITS |
| % OF ALL PLAYERS CURRENTLY PLAYING | 15% | 25% | 5% | 35% | 20% |

FIG. 6

700

| INSTRUCTION 710 | CONDITION 712 |
|---|---|
| SWITCH TO GAME "B" | 10 CONSECUTIVE LOSSES ON GAME "A" |
| SWITCH TO GAME "B" | $100 OR MORE LOST ON GAME "A" |
| SWITCH TO GAMES HAVING: | THE GREATEST POPULARITY IN THE LAST HOUR |
| SWITCH TO GAMES HAVING: | HIGHEST PAYBACK PERCENTAGES IN THE LAST HOUR |
| SWITCH TO GAMES HAVING: | HIGHEST PAID WINNING GAME OUTCOMES IN THE LAST HOUR |
| SWITCH TO ANY GAME SELECTED FROM GAMES "A", "B", "C" AND "Z" HAVING: | HIGHEST PAYBACK PERCENTAGES IN THE LAST HOUR |
| SWITCH TO GAME "B" | 10 CONSECUTIVE WINS ON GAME "A" |

FIG. 7

900

SELECT CONDITIONS AND INSTRUCTIONS FOR DETERMINING GAME SERIES

910

| CONDITIONS 920 | INSTRUCTIONS 930 | STATUS 940 |
|---|---|---|
| GAMES WITH HIGHEST PAYBACK PERCENTAGE IN THE LAST HOUR | SELECT TOP 5 GAMES | ACTIVE |
| GAMES WITH A WINNING GAME OUTCOME FROM PREVIOUS GAME SERIES | PLAY AGAIN IN NEXT GAME SERIES | ACTIVE |
| GAMES WITH A LOSING GAME OUTCOME FROM PREVIOUS GAME SERIES | DELETE GAME FROM NEXT GAME SERIES | ACTIVE |
| MOST POPULAR GAMES | SELECT TOP FIVE MOST POPULAR GAMES | INACTIVE |
| 10 CONSECUTIVE LOSSES IN ANY GAME | DELETE GAME FROM NEXT GAME SERIES | INACTIVE |

SAVE THESE INSTRUCTIONS

905

FIG. 9

METHOD AND APPARATUS FOR DETERMINING A GAME SERIES COMPRISING A PLURALITY OF INDIVIDUALLY SELECTABLE WAGERING GAMES

PRIORITY CLAIM

This application is a continuation of, and claims priority to and the benefit of, U.S. patent application Ser. No. 13/198,473, filed on Aug. 4, 2011, which is a continuation of, and claims priority to and the benefit of, U.S. patent application Ser. No. 11/336,245, filed on Jan. 20, 2006, which issued as U.S. Pat. No. 8,016,657 on Sep. 13, 2011, the entire contents of each of which are incorporated herein by reference.

CROSS REFERENCE TO RELATED APPLICATIONS

This application is related to commonly-owned U.S. patent application Ser. No. 11/299,341, which was filed on Dec. 9, 2005, issued as U.S. Pat. No. 7,918,736, and is entitled "METHOD AND APPARATUS FOR USING CONDITIONAL PARAMETERS TO ALTERNATE BETWEEN WAGERING GAMES," the conditional parameter and wagering game alternation concepts and descriptions of which are hereby incorporated herein by reference.

FIELD

The method and apparatus relate to gaming apparatus, and in particular to wagering methods that provide players a game series comprising a plurality of individual selectable wagering games.

BACKGROUND

Gaming has become an increasingly important industry in the United States and around the world. In games of chance, a player typically places a wager on one or more games, and either receives a payout or loses the wager based on the game outcome. Examples of gaming devices include, without limitation, video poker gaming devices, mechanical reel slot machines, and video slot machines.

Traditionally, players have been relegated to playing a single game on a gaming device. More recently, some gaming devices allow players to select a game from multiple games available on a single gaming device. For example, some gaming devices allow players to navigate a "menu" system for selecting different types of games. The player selects a game from the menu and plays until another game is desired. The player then exits the game and returns to the menu screen to select another game (e.g., a player plays a Keno game, backs out to a menu screen, selects a video poker game, and continues play on the video poker game).

Manual switching between games is time-consuming and cumbersome for many players. In addition, this manual game switching falls short of adding substantial new interest to game play. New methods are needed for alternating between individual wagering games to provide greater entertainment value.

BRIEF DESCRIPTION OF THE DRAWINGS

Various embodiments are described herein with reference to the accompanying drawings. In the drawings, like reference numerals indicate identical or functionally similar elements. The leftmost digit(s) of a reference numeral typically identifies the figure in which the reference numeral first appears. As will be understood by those skilled in the art, the drawings and accompanying descriptions presented herein indicate some exemplary arrangements. Similarly, the illustrated entries represent exemplary information, but those skilled in the art will understand that the number and content of the entries can be different from those illustrated herein. A brief description of the drawings follows.

FIG. 4 is an example of a player database with exemplary entries that may be associated with a player tracking program;

FIG. 6 is an example of a parameters database with exemplary entries;

FIG. 7 is an example of a reconfiguration database with exemplary entries;

FIG. 9 is an exemplary embodiment of a video display illustrating an example of a selection menu for determining a subsequent game series;

DETAILED DESCRIPTION OF EMBODIMENTS

Figure 1:
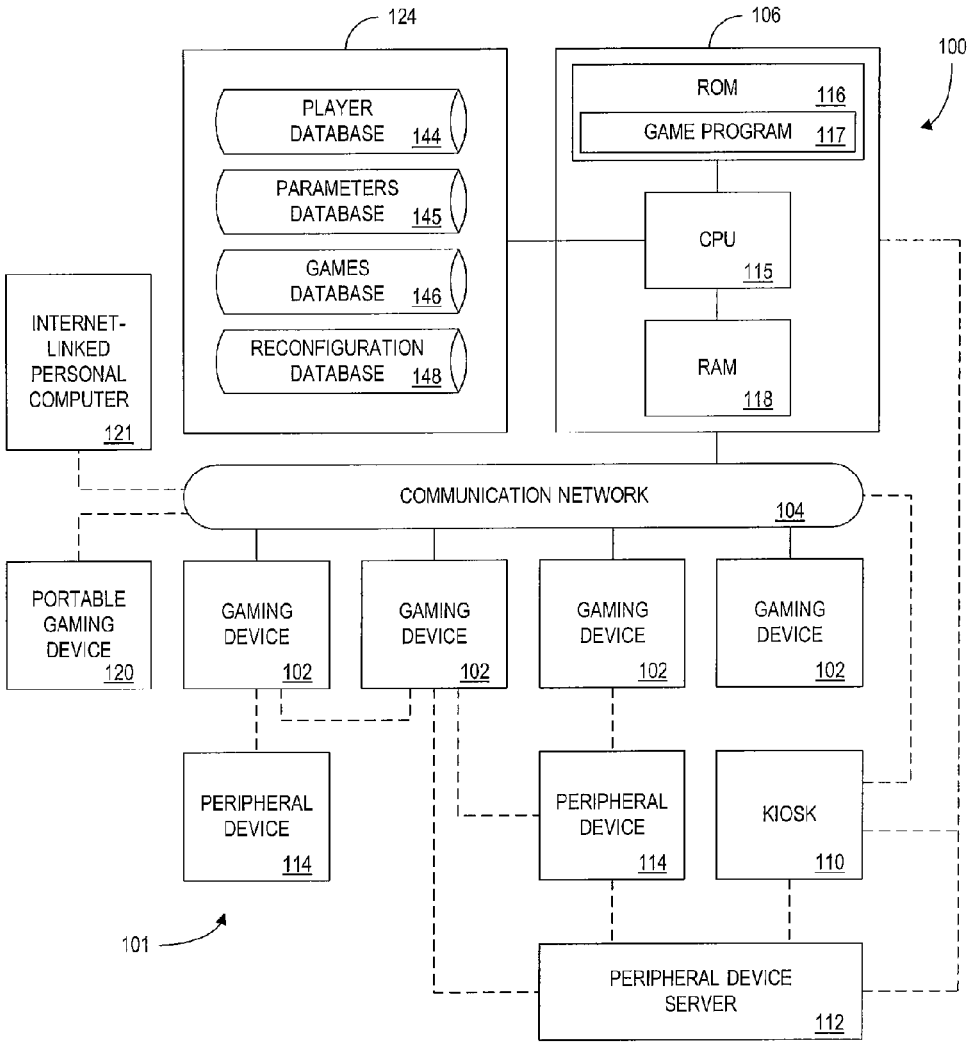
FIG. 1 is an overall schematic view of one embodiment of a gaming network.

Numerous embodiments are described in this patent application that are presented for illustrative purposes only. The described embodiments are not intended to be limiting in any sense. The invention is widely applicable to numerous embodiments, as is readily apparent from the disclosure herein. These embodiments are described in sufficient detail to enable those skilled in the art to practice the invention, and it is to be understood that other embodiments may be used and that structural, logical, software, electrical and other changes may be made without departing from the scope of the present invention. Accordingly, those skilled in the art will recognize that the present invention may be practiced with various modifications and alterations.

Although particular features may be described with reference to one or more particular embodiments or figures that form a part of the present disclosure, and in which are shown, by way of illustration, specific embodiments of the invention, it should be understood that such features are not limited to usage in the one or more particular embodiments or figures with reference to which they are described. The present disclosure is thus neither a literal description of all embodiments of the invention nor a listing of features of the invention that must be present in all embodiments.

Certain embodiments will now be described in detail with reference to the drawings. Although the embodiments discussed herein are directed to video gaming devices (e.g., video poker machines, video blackjack machines, video roulette, video keno, and the like), it should be understood that the embodiments are equally applicable to slot type gaming devices with mechanical reels.

To provide greater entertainment value a method of wagering has been devised that allows a player to purchase a game series comprising a block of individual wagering games selected from a plurality of games offered through an individual gaming device. The outcome of each individual wagering game in the series is presented to the player sequentially. The player may then continue wagering on subsequent game series that have been the modified to comprise individual wagering games meeting player specified conditions. The continual evolution of the individual wagering games comprising each subsequent game series creates interest in the game play.

Generally, a process will be described comprising the following steps (i) determine a first plurality of individual wagering games comprising a first game series, (ii) display the game outcomes for the first plurality of individual wagering games, (iii) determine a second plurality of individual wagering games comprising a second game series based on the game outcomes of the first series, and (iv) display the game results from the second game series. Various embodiments and variations related to this process will now be described.

The game series is purchased as a block of games. Player entertainment value is also maximized through the player's capability to customize game play by specifying the individual wagering games comprising the game series by specifying conditions and parameters under which an instruction is automatically implemented to alter the composition of the game series. Allowing for the contents of a game series to be determined automatically by various game play parameters may also provide players with additional entertainment value through the unexpected appearance of a variety of wagering games with which the player may not be familiar. Equally important is the entertainment value of a game that continually determines the games the player has had the greatest wagering success and which continually offers those games automatically to the player.

Referring now to FIG. 1, illustrated therein is an example embodiment of a gaming network 100 that may be used to implement one or more embodiments generally described above. The gaming network 100 of FIG. 1 includes a plurality of network devices 101 that are directly or indirectly in communication with the gaming network 100 to accept wagers, determine game outcomes, and provide payouts for winning game outcomes. Among these network devices 101 are a gaming server 106 (that is in communication with one or more other network devices), a gaming device 102 (e.g., video slot machines, video poker machines, mechanical reel slot machines), a kiosk 110, a merchant point-of-sale (POS) terminal (not shown), a peripheral device server 112, various component devices (e.g., display screens) (not shown), various peripheral devices 114 associated with the gaming device (e.g., card readers), a portable gaming device 120 (e.g., PDA or cell phone), and an Internet linked personal computer 121. These devices and their functions are described in detail below.

Each gaming device 102, and every other network device 101 in the gaming network 100 that communicates with another network device in the gaming network, is uniquely identified by a device identification (ID) number, to allow communication with the gaming server 106 via the gaming network 100. The gaming network 100 may communicate with devices directly or indirectly, via a wired or wireless medium to a communication network 104 such as the Internet, LAN, WAN or Ethernet, Token Ring, or via any appropriate communications means or combination of communications means. It is to be understood, however, that other arrangements in which the gaming devices 102 communicate with the server 106 are also possible.

A variety of communications protocols may be part of the system, including but not limited to: Ethernet (or IEEE 802.3), SAP, SAS, SUPERSAS™, ATP, BLUETOOTH®, and TCP/IP. Further, in some embodiments, various communications protocols endorsed by the Gaming Standards Association of Fremont, Calif., may be utilized, such as (i) the Gaming Device Standard (GDS), which may facilitate communication between a gaming device 102 and various component devices and/or peripheral devices 114 (e.g., printers, bill acceptors, etc.), (ii) the Best of Breed (BOB) standard, which may facilitate communication between a gaming device 102 and various servers 106 related to play of one or more gaming devices (e.g., servers that assist in providing accounting, player-tracking, content management, ticket-in/ticket-out and progressive jackpot functionality), and/or (iii) the System-to-System (S2S) standard, which may facilitate communication between game-related servers 106 and/or casino property management servers (e.g., a hotel server comprising one or more databases that store information about booking and reservations). Communication may be encrypted to ensure privacy and prevent fraud in any of a variety of ways well known in the art.

The gaming device 102 may be implemented as a system server, a dedicated hardware circuit, an appropriately programmed general-purpose computer, or any other equivalent electronic, mechanical or electro-mechanical device. The gaming device 102 may comprise any or all of the gaming devices of the aforementioned systems.

In some embodiments, a gaming device 102 may comprise a portable gaming device 120—for example, a portable gaming device (e.g., a device similar to a PDA) or a cell phone that may be used in place of, or in addition to, some or all of the gaming device components. The portable gaming device 120 may be used to view "walk away" game outcomes from a gaming device 102. Methods for viewing walk away game outcomes are described in applicants' U.S. Pat. No. 6,012,983, filed Dec. 30, 1996, entitled "AUTOMATED PLAY GAMING DEVICE" and U.S. Pat. No. 6,964,611, filed Aug. 15, 2001 entitled "SYSTEM AND METHOD FOR AUTOMATED PLAY OF LOTTERY GAMES" the entirety of each are incorporated herein by reference for all purposes.

In this situation, the portable gaming device 120 is in communication with the gaming device 102 in the gaming network 100. Game outcomes are automatically generated by the gaming device 102 and communicated to the player on the portable gaming device 120. This allows the player the convenience of walking anywhere in the gaming establishment and still receive game outcomes from the player's gaming device 102. Game outcomes from a player's gaming device 102 may be communicated or alternately, directly from the server in a central determination system, to the player's portable gaming device 120 (such as a PDA or cell phone) to enable a player to remotely view game outcomes received from the gaming device.

Further, a gaming device 102 may comprise an Internet linked personal computer 121 that may be operable to communicate with an online casino and facilitate game play at the online casino. In one embodiment, the Internet linked personal computer 121 may receive game outcomes produced by a gaming device 102 in the gaming establishment similar to the portable gaming device 120 described above. In one embodiment, the gaming server 106 communicates the game outcomes received from a player's gaming device 102 to the player's personal computer 121.

The peripheral device server 112 may be available to provide additional communication capabilities between peripheral devices 114 in the gaming network 100. These peripheral devices 114 may include player-tracking devices, additional screen displays, ticket readers and printers, etc.

In some embodiments, a kiosk 110 may be configured to execute or assist in the execution of various processes of the gaming network 100. In some embodiments, a kiosk 110 may comprise a processor and a memory. A kiosk 100 may also comprise various input devices (e.g., a keypad, a keyboard, a mouse, buttons, a port that receives player tracking cards, an optical scanner for reading bar codes or other indicia, a CCD camera, etc.), output devices (e.g., a display screen, audio speakers, etc.), benefit output devices (e.g., a coin tray or printer for printing cash-less gaming vouchers), combinations thereof (e.g., a "ticket-in/ticket-out" device, a touch-sensitive display screen, etc.), communications ports, and so on. Thus, a kiosk 110 may comprise many of the features and components of a gaming device 102, though the kiosk itself may not necessarily be configured to enable gambling activity as a primary function. A kiosk may communicate with any or all of (i) a gaming server 106, (ii) a gaming device 102, (iii) an inventory/reservation system of a casino-maintained property (e.g., a hotel), (iv) casino personnel devices, (v) merchant POS terminals, and so on. A number of kiosks 110 may be stationed within casino premises (e.g., at various locations on a slot floor).

In various embodiments, kiosks may execute or assist in the execution of (i) determining and outputting a player status or other types of data described herein (e.g., a kiosk receives a player tracking card, and provides a description of the player's redeemable awards), (ii) outputting payments to players (e.g., upon receipt of cash-less gaming vouchers, player tracking cards, smart cards, etc.), and/or (iii) any other process described herein. Thus, such a device may be configured to read from and/or write to one or more databases. The memory of such a device may store a program for executing such processes.

The kiosk 110 may be available for allowing a player to customize the gaming experience or cash out game winnings. The kiosk 110 may also be available to the player for purchasing flat-rate gaming sessions, purchasing goods and services with player loyalty points.

The gaming device 102, the kiosk 110, and the peripheral device server 112 as well as all other network devices 101 are in communication with the gaming server. The gaming server 106 will now be described in detail with reference to FIG. 1. Like the gaming device 102, the gaming server 106 has a central processing unit CPU 115. The server executes the instructions of a program 117 stored in Read Only Memory (ROM) 116 and executed from Random Access Memory RAM 118. Additionally, the CPU 115 is coupled to a data storage device 124, having a plurality of databases.

In order to communicate with gaming devices 102 and/or another device, the gaming server 106 also includes a communication port. The communication port connects the server CPU 115 to the gaming device 102. Thus, the CPU 115 of the gaming server 106 can control the communication port to receive information from the data storage device 124 and transmit information to the gaming device 102 and vice versa.

The player database 144 may serve as one example of the communication capability of the communication network 104 to exchange data between the gaming server 106 and the gaming device 102. The player database 144 may be used to store data associated with specific players that are members of a gaming establishment's player loyalty program. The player database 144 stores player wagering data that can be converted into loyalty points and accumulated in the player's account.

These player loyalty programs reward players with complementary points as players wager on the gaming establishment's gaming devices. These loyalty points are generally redeemable for gifts and other discounts on goods and services, especially those offered by the gaming establishment.

The player database 144 may alternately or additionally store various other data associated with a player, such as the type of game or gaming device a player is currently playing or has played, the length of time a player has played a certain game or machine, information regarding wins and losses (e.g., a total amount won/lost for a given period of time, consecutive wins/losses, percentage of all plays that are wins/losses, etc.).

The player database 144 may also contain information that may be useful for satisfying player needs (e.g., information about the player's gaming preferences (such as which games the player prefers and/or under what conditions the player prefers to switch from one game to another), gaming sessions, outstanding debts, lodging arrangements, and the like). For example, the player database 144 may store data regarding a given player's standing in a game session or bonus game, so that the player can continue the game session or bonus game at one of a plurality of gaming devices that have common access to the player database 144.

As will be described in detail below, in one embodiment, the player tracking system operates through gaming device 102 to communicate a player's identifying information to the gaming server 106. The gaming server 106, in turn, collects statistical data regarding the player's game play (e.g., wagering activity). Player data may be stored in a relational database and retrieved or otherwise accessed by the CPU 115 after receiving a "key" data point from the player, such as a unique identifier read from the player's player-tracking card or cash-less gaming voucher, PIN or code entered by a player using an input device of the gaming device 102, etc. It is contemplated that players may also identify themselves in a variety of other manners, such as by providing biometric identifiers, RFID identity devices, etc.

The player database 144 of the present embodiment may include multiple records having multiple fields of information. For example, FIG. 4 illustrates an embodiment of a player database 400 with exemplary entries. This player database is an example of the player database 144 illustrated in FIG. 1. The player database 400 comprises multiple records, each record being associated with a particular player, as identified by a player identification (ID) number 410. The fields within each record include player identification (ID) number 410, Social Security number 412, name 414, address 416, telephone number 418, credit card number 420, credit balance 422, accumulated complimentary points 424, whether the player is a hotel guest 426, and player status rating 428. Having information related to one field, such as player ID 410, allows the gaming server 106 to retrieve all information stored in corresponding fields of that player record.

Various systems for facilitating such monitoring are contemplated. For example, a two-wire system such as one offered by International Gaming Systems (IGT) may be used. Similarly, a protocol such as the IGT SAS™ or SuperSAS™ protocol may be used. The SAS™ and SuperSAS™ protocols allow for communication between gaming devices and slot accounting systems and provide a secure method of communicating all necessary data supplied by the gaming device to the online monitoring system. One advantage of the SAS™ and SuperSAS™ protocols is the authentication function which allows operators and regulators to remotely interrogate gaming devices for important memory verification information, for both game programs, and peripheral devices. In another example, a one-wire system such as the OASIS™ System offered by Aristocrat Technologies™ or the SDS slot-floor monitoring system offered by Bally Gaming and Systems™ may be used. Each of the systems described above is an integrated information system that continually monitors slot machines and customer gaming activity. Thus, for example, any one of these systems may be used to monitor a player's gaming activity in order to determine player outcomes, coin-in statistics, win/loss statistics and/or any other data deemed relevant Turning back to FIG. 1, the gaming network 100 may have a data storage device 124 for storing the player database 144 as well as storing other types of data in a number of databases. Examples of such databases include, but are not limited to, (i) a games database 146 that stores game software for a plurality of games playable on and/or downloadable to one or more gaming devices 102, (ii) a parameters database 145 for storing game play related parameters for each of a plurality of games, and (iii) a reconfiguration database 148 for determining conditions under which a game series is altered to create a new game series.

It is to be understood that because the gaming devices 102 are in communication with the gaming server 106, information stored in a gaming device 102 may be stored in the gaming server 106 and vice versa. Thus, for example, in an alternate embodiment, the gaming device 102, rather than the data storage device 124 may store one or more of these databases. In other embodiments, some or all of these databases may be partially or wholly stored in another network device 101, such as in a peripheral device server 112, a kiosk 110, the gaming server 106, or other gaming devices 102, etc.

It will be understood by one of ordinary skill in the art that (i) alternative database structures to those described herein may be readily employed; and (ii) other memory structures besides databases may be readily employed. Any schematic illustrations and accompanying descriptions of any sample databases presented herein are illustrative arrangements for stored representations of information. Any number of other arrangements may be employed besides those suggested by the tables shown.

Similarly, any illustrated entries of the databases represent exemplary information only; those skilled in the art will understand that the number and content of the entries can be different from those illustrated herein. Further, despite any depiction of the databases as tables, other formats (including relational databases, object-based models and/or distributed databases) could be used to store and manipulate the data types described herein. Likewise, object methods or behaviors of a database can be used to implement the processes described herein. In addition, the databases may, in a known manner, be stored locally or remotely from a device, that accesses data in such a database.

With the communication network 104 and access to data from the data storage device 124, the gaming server 106 may be operable to configure (or reconfigure) a gaming device 102 remotely, update software stored on a gaming device 102 and/or to download software or software components to a gaming device 102. For example, a database (e.g., a payout or probability database) stored in the memory of gaming device 102 may be altered, modified, or updated remotely, hot fixes may be applied to software stored by the gaming device 102, and/or new software may be downloaded to the gaming device. Game software may be downloaded as needed to provide specific games desired by a player in real time. Similarly, the gaming device 102 may be programmed to retrieve any or all such updates from another device.

Gaming server 106 may be programmed (e.g., with program 117) to perform any or all of the above functions based on, for example, an occurrence of an event (e.g., a scheduled event), satisfying a condition, receiving an indication from a qualified casino employee and/or other person (e.g., a regulator), receiving a request from a player, and/or the satisfaction of a condition stored in a reconfiguration database 148.

It should be noted that such embodiments may be advantageous in environments or jurisdictions wherein the "central determination" of outcomes is required by regulation or otherwise preferred. Thus, for example, outcomes may be determined centrally by a game server, and then propagated (e.g., electronically) such that indications of the outcomes may be viewed using one or more gaming devices (e.g., "Class II" gaming devices, "thin-client" gaming devices in a server-based "Class III" gaming architecture, Video Lottery Terminals, and so on). In this embodiment, the gaming device 102 essentially comprises a thin client device controlled by the gaming server 106. The gaming server 106 may determine game outcomes for each of the gaming devices 102 and transmit those game outcomes (including associated graphics and audio data in some embodiments) to the gaming device 102. Multiple instances of the same game may be transmitted to different players on different gaming devices (i.e., the same game on the server 106 may be producing different game outcomes for different players playing at the same time at different gaming devices). In some embodiments, a plurality of game outcomes may be transmitted from the gaming server 106 to a gaming device 102 substantially simultaneously, pursuant to play of a game series.

Figure 2:
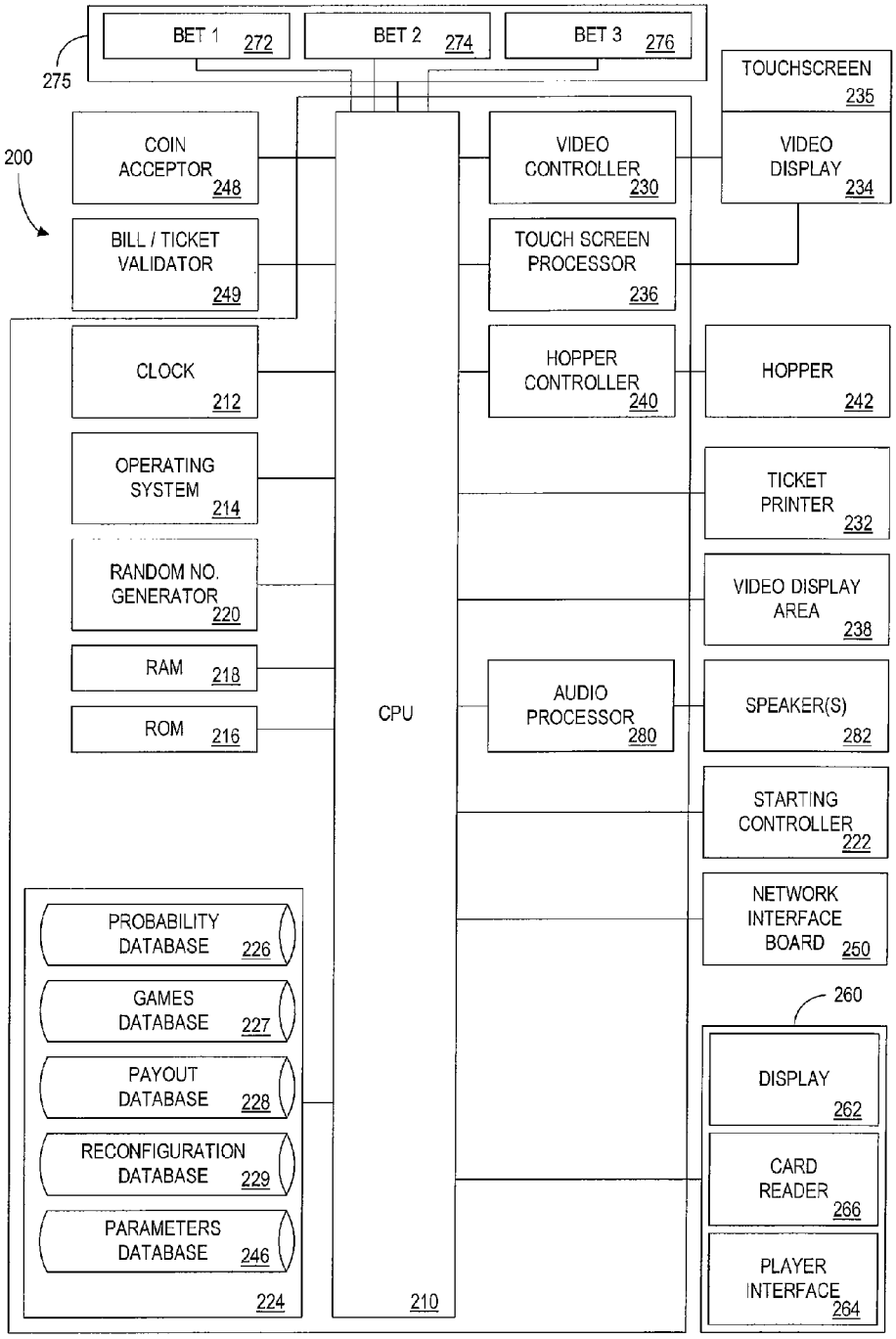
FIG. 2 is a schematic view of the gaming device of FIG. 1.

Referring now to FIG. 2, illustrated therein is one embodiment of a block diagram for a gaming device 200. The gaming device 200 may be an embodiment of a gaming device 102 shown in FIG. 1. The gaming device 200 has a CPU 210, which is communication with the communication network 104 of FIG. 1 through a network interface board 250. The network interface board 250 provides a communication path from the gaming device 200 to gaming server 106 through the gaming network 100. Thus, as discussed in detail below, information can be communicated between the gaming device 200 through its CPU 210 to the gaming server 106. In addition, the player-tracking device 260 and its associated player interface 264 (e.g., a keypad) which is also in communication with the gaming device's CPU 210, may provide a communications link between the player and the gaming device 200 or even the gaming server 106 through the gaming device's 200 CPU 210.

With respect to some gaming operations, the gaming device 200 operates in a conventional manner. The player starts the gaming device 200, for example, by inserting a coin into the coin acceptor 248 or a bill into the bill validator 249. A starting controller 222 may initiate operation of the gaming device 102 to produce a random game outcome.

The gaming device 200 contains a Central Processing Unit (CPU) 210 that executes instructions of a program 214 stored in Read Only Memory (ROM) 216 for playing the gaming device 200. The CPU 210 performs instructions of the program 214 and thereby operates to perform in accordance with the methods described in detail herein. The program 214 may be stored in a compressed, uncompiled, and/or encrypted format. The program 214 may also include program elements that may be necessary, such as an operating system, a database management system and "device drivers" for allowing the processor to interface with computer peripheral devices.

According to one embodiment, the instructions of the program may be read into a main memory (e.g., Random Access Memory (RAM) 218) from another computer-readable medium such as from a ROM 216. The system bus carries the data to main memory, from which the CPU 210 retrieves and executes the instructions. The instructions received by main memory may optionally be stored in memory either before or after execution by the CPU 210. RAM 218 may also temporarily store information communicated to it by the CPU 210 during game play.

Execution of sequences of the instructions in program 214 causes CPU 210 to perform the process steps described herein. In alternate embodiments, hard-wired circuitry may be used in place of, or in combination with, software instructions for implementation of the reconfiguration process. Thus, the various embodiments are not limited to any specific combination of hardware and software.

The CPU 210 and the memory 216 and 218 may each be, for example: (i) located entirely within a single computer or other device; or (ii) connected to each other by a remote communication medium, such as a serial port cable, telephone line, or radio frequency transceiver. In one embodiment, the gaming device 200 may comprise one or more devices that are connected to a remote server for maintaining databases.

Under control of a program stored, for example ROM 216, the CPU 210 initiates the RNG 220 to generate a random number. The random number generator 220, in accordance with at least one embodiment, may generate data representing random or pseudo-random values (referred to as "random numbers" herein).

The random number generator 220 may generate a random number, for example, every predetermined unit of time (e.g., every thousandth of a second) or in response to an initiation of a game on the gaming device 102. In the former embodiment, the generated random numbers may be used as they are generated (e.g., the random number generated at substantially the time of game initiation is used for that game) and/or stored for future use. A random number generated by the random number generator 220 may be used by the CPU 210 to determine, for example, at least one of an outcome and payout.

A random number generator 220, as used herein, may be embodied as a secondary processor, separate from, but working in cooperation with the CPU 210. Alternatively, the random number generator 220 may be embodied as an algorithm, program component, or software program stored in the memory of the gaming device 200 and used to generate a random number. Note that, although the generation or obtainment of a random number is described herein as involving a random number generator 220 of a gaming device 200, other methods of determining a random number may be employed.

For example, a gaming establishment may obtain sets of random numbers that have been generated by another entity. For example, there are services that provide random numbers that have been generated by timing successive pairs of radioactive decays detected by a Geiger-Muller tube interfaced to a computer.

As would be understood by one of ordinary skill in the art, a random number generator 220 may be stored in a device other than a gaming device 200. For example, in some embodiments, a gaming device 200 may receive random numbers and/or any other data related to the random or pseudo-random determination of an outcome from a separate device, such as the gaming server 106 shown in FIG. 1. In fact, the gaming server 106 (and/or the data storage device 124) may contain not only the random number generator 220, but also the probability and pay table databases necessary to determine a winning game outcome, and the payout award for such a winning game outcome. This arrangement might be implemented in a thin-client type gaming device (i.e., a dumb terminal or smart-enough terminal).

The CPU 210 as shown in FIG. 2 looks up the generated random number in a stored probability database 226, which contains a list that matches random numbers to corresponding game outcomes to determine a game outcome based on the generated random number.

A probability database 226 may be stored in the gaming device's 200 ROM 216 or in any other data storage device. The data stored therein may include a number of exemplary records or entries, each defining a random number. Those skilled in the art will understand that the probability database may include any number of entries. The tabular representation may also define fields for each of the entries or records. The fields may specify: (i) a random number (or range of random numbers) that may be generated by the random number generator 220; and (ii) an outcome that indicates the one or more indicia comprising the outcome that corresponds to the random number of a particular record. These indicia comprise the game outcome that is then displayed to the player in the primary video display 234.

The indicia representing the game outcome may comprise reel symbols commonly displayed on the reels of slot type gaming devices. The indicia may also be cards from a card deck displayed on the video display on a video poker gaming device. For example, the book "Winning at Slot Machines" by Jim Regan (Carol Publishing Group Edition, 1997) illustrates examples of payout and probability tables and how they may be derived. The entirety of this book is hereby incorporated by reference herein for all purposes.

Based on the identified game outcome, the CPU 210 locates the appropriate payout in a stored payout database 228. The payout database 228 may be stored in the gaming device's 200 RAM 218 (alternatively, the payout database may also be stored in any other data storage device).

A payout database 228 may store a number of entries associated with each possible game outcome represented by the indicia determined by the probability table. The tabular representation defines fields for each of the entries or records. The fields specify: (i) an outcome, which indicates the one or more indicia comprising a given outcome, and (ii) a payout that corresponds to each respective outcome.

The outcomes may be those obtained from winning game outcomes typically obtainable on a video poker gaming device (e.g., royal flush, straight flush, straight, four-of-a-kind, full house, two pair, three-of-a-kind, and pair). With the payout database 228, the payout of any winning game outcome can be determined. Alternatively, game outcomes may be represented by reel symbols; with winning game outcomes determined by the order and type of symbol as presented in the display.

The described entries of the probability database 226 and the payout database 228 represent exemplary information only; those skilled in the art will understand that the number and content of the entries can be different from those illustrated herein. Further, despite any description of the databases as tables, an object-based model could be used to store and manipulate the data types and likewise, object methods or behaviors can be used to implement the processes described herein.

In addition to determining a game outcome, the CPU 210 controls a variety of peripheral devices associated with the gaming device that may be used to assist the player in making wagers and receiving payouts. The CPU 210 is operable to communicate (e.g., via a protocol such as GDS) with these various peripheral devices associated with the gaming device 102.

The following is a description of some of these peripheral devices that are available in gaming devices 200. These peripheral devices may be classified as either input devices (e.g., player to gaming device), output devices (e.g., gaming device to player), or interface devices that have both input and output type characteristics. It should be understood that not all of the peripheral devices are necessary, and further, that the peripheral devices may be used in any combination, including using a plurality of the same peripheral device in a single gaming device 200.

Some examples of input devices include wager acceptors, for initiating game play on the gaming device 200, such as the coin acceptor 248. A coin acceptor 248 is coupled to the CPU 210. Each coin received by the coin acceptor 248 is registered by the CPU 210. A hopper controller 240 is connected to a hopper 242 for dispensing the collected coins when a winning game outcome occurs. In addition, when the player requests to cash out by pushing a cash out button (not shown) on the gaming device 200, the CPU 210 checks the RAM 218 to see if the player has any credit and, if so, signals the hopper controller 240 to release an appropriate number of coins into a payout tray (not shown).

Another type of wager acceptor is the bill/ticket validator 249. The bill/ticket validator accepts either paper currency or ticket vouchers. This voucher operates similarly to cash and is generally accepted by most gaming devices 200 in the gaming establishment with a bill/ticket validator 249.

The voucher is printed by a ticket printer 232 located in the gaming device 200. For example, when a player cashes out, instead of accepting payment in coin, the player may request a ticket voucher. The credit balance on the credit balance meter of the gaming device 200 is indicated on the ticket voucher. The ticket voucher generally contains a bar code and other legible indicia that indicate the gaming establishment and the monetary value of the voucher.

The bar code on the voucher is machine-readable by the bill/ticket validator 249. The player simply inserts the voucher (as the player would for paper currency) into the bill/ticket validator 249 and the value of the voucher is determined. The gaming device 200 communicates with a gaming server 106 (shown in FIG. 1) that manages the accounting associated with such ticket-in/ticket-out transactions (e.g., to track the issuance, redemption and expiration of such vouchers). An example of such ticket-in/ticket-out technology, the EZ PAY system, is manufactured by International Gaming Technology, headquartered in Reno, Nev. The monetary value of the voucher is displayed on the gaming device's credit meter and is available for wagering. Other forms of payment may be available including the use of credit cards, debit cards, credits/currency from electronic accounts (e.g., a player "downloads" credits from a central server), etc. to make wagers.

Also in communication with the CPU 210 is a player-tracking device 260. The CPU 210 is in turn in communication with a server 106 (shown in FIG. 1) that contains the player database 144. The player-tracking device 260 has a card reader 266 as shown in FIG. 2, which accepts a player-tracking card for reading player-identifying information stored on a player-tracking card (e.g., a player identification (ID) number). Although not so limited, the player-tracking card of the present embodiment stores the player ID on a magnetic strip located thereon. Alternatively, any player identifying indicia may be used, including biometric indicia.

The player-tracking device 260 has a player-tracking display 262 and a player interface 264 that allows the gaming device 200 and/or server 106 to communicate with the player. The player interface 264 may include a keypad and/or a touch-screen display. The player-tracking device 260 may be used to not only track player wagering, but also used to specify conditions and instructions for the reconfiguration of gaming device 200.

Other examples of input devices that facilitate game play include the pushbutton panel 275. The pushbutton panel 275 allows the player to make various choices including wager amounts and games selections. The gaming device 200 also includes a series of bet buttons 272, 274, 276. The bet buttons include "Bet 1 coin" 272, "Bet 2 coins" 274, and "Bet 3 coins" 276. The bet buttons 272, 274, 276 are coupled to the CPU 210. Therefore, pressing one transmits a signal to the CPU 210 indicating how much a player is wagering on a given play. Other examples of input devices include keypads, microphones, video camera, etc. may be in communication with the CPU 210 or with the player-tracking device 260.

The CPU 210 may also be operable to communicate with various output devices. In some embodiments, an output device comprises a game display. The primary video display 234 may comprise, for example, one or more display screens or areas for outputting information related to game play on the gaming device 200, such as a cathode ray tube (CRT) monitor, liquid crystal display (LCD) screen, and/or light emitting diode (LED) screen.

In one or more embodiments, a gaming device 200 may comprise more than one game display. For example, a gaming device 200 may comprise an LCD display for displaying electronic reels (or card hands in the case of a video poker gaming device) (e.g., a primary video display 234) and a display area that displays rotating mechanical reels.

Alternately, a gaming device 200 may have a video display 234 for the outcome of a primary game played on the gaming device and a secondary video display 238 may display rules for playing a game of the gaming device, the outcome of secondary games played in conjunction with the primary game, and various other games being offered to a player (e.g., a selectable list of the "top 10" games in terms of coins paid out in the past hour is constantly refreshed and displayed in a secondary area). In one embodiment, a primary video display 234 may generally output game results of a current series, while a secondary video display 238 may be used to display the (potentially changing) composition of one or more upcoming series.

The CPU 210 may also be in communication with one or more other output devices. Such devices may comprise, for example, a primary video display 234 through a video controller 230, an audio speaker 282 through an audio processor 280; headphones; an infrared transmitter; a radio transmitter; an electric motor, etc. The CPU 210 may also be in communication with a wireless portable gaming device 120 (shown in FIG. 1) that may receive in some embodiments game outcomes from gaming device 200.

Another type of output device is required to pay off winning game outcomes. For example, the coin hopper 242 may pay out coins from the gaming device or a ticket voucher may be provided for a winning game outcome. In yet another example, the gaming device 200 may credit a monetary amount to a financial account (not shown) associated with a player as a pay out provided to a player. The financial account may be, for example, a credit card account, a debit account, a charge account, a checking account, or a casino account (e.g., an account from which the player may access cashable and/or non-cashable funds using a player tracking card or smart card).

A gaming device 200 may also include a touch screen 235 and a touch screen processor 236 associated with a primary video display 234. The touch screen 235 and touch screen processor 236 may be operable to communicate with a video controller 230 of the primary video display 234 and a CPU 210. Thus, a player may be enabled to indicate decisions or choices by touching the touch screen 235 in the appropriate places.

The primary video display 234 may operate in conjunction with the video controller 230 in the CPU 210 to produce multiple separate images on the gaming device 200. Each of these separate images may originate from a separate and independent video signal. This allows a single primary video display 234 to display a plurality of separately and independently acquired images.

Figure 3:
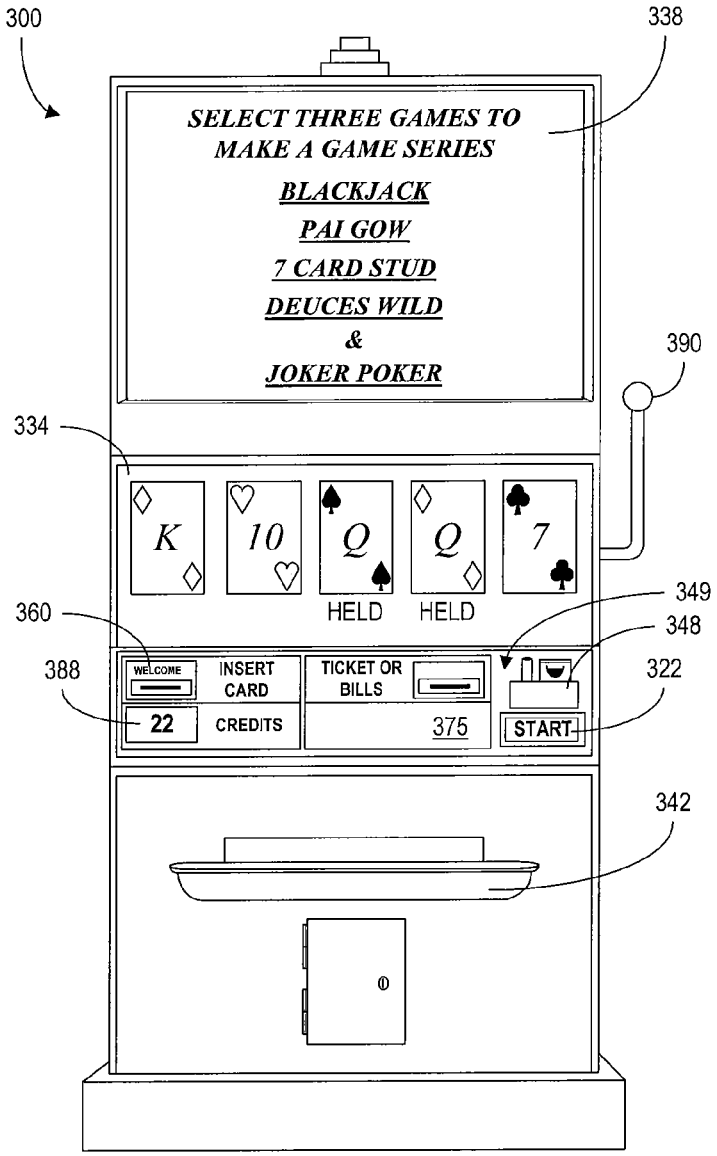
FIG. 3 is an orthographic view of the gaming device of FIG. 1.

Turning to FIG. 3, an orthographic view of a gaming device 300 is presented, in accordance with one example embodiment. The gaming device 300 may comprise, in one embodiment, for example, gaming device 200 of FIG. 2 and/or a gaming device 102 of FIG. 1. A number of peripheral components are visible on the gaming device 300 and are explained below from the view of a wagering player.

A gaming device 300 may comprise a display area in which a game outcome is displayed to the player. The display area may, for example, be a video display 338 that displays graphical representations of reel symbols or other indicia used to indicate a game outcome. The display area may, in another example, be glass behind which are located mechanical reels.

A player desiring to wager on gaming device 300 may first present a player-tracking card to the player-tracking device 360 associated with gaming device 300 to accrue player loyalty points. The gaming device 300 has two wager acceptors—a coin acceptor 348 and a bill/ticket acceptor 349. The wager is registered on the credit meter 388. Once a wager has been placed, the player can start the gaming device 300 with the pull handle 390 or the start button 322 on the pushbutton panel 375. The game outcome is shown on the primary video display 334.

A secondary video display is also available to present additional player or game information. To increase the display capability of the gaming device 300 even further, video display 334 and/or 338 may be configured to provide a plurality of separately and independently obtained video images on a single video display. Pictures may overlap or be displayed separately. Some images may be ghosted or semi-transparent and overlap. Overlapped images may form a single image.

Finally, the slot machine may comprise a coin tray 342. Payment to the player may be rendered by dispensing coins into the coin tray. Such coins may be dispensed based on, for example, a player's indication that the player would like to cash out his credit meter balance and/or a payout obtained by a player as a result of playing a game on the gaming device 300.

With a basic understanding of the gaming device and the gaming network in which it may operate in one embodiment, the process for forming the game series from individually selected games is explained in further detail below.

EXEMPLARY PROCESS EMBODIMENT FOR THE FORMATION OF A GAME SERIES

Figure 5:
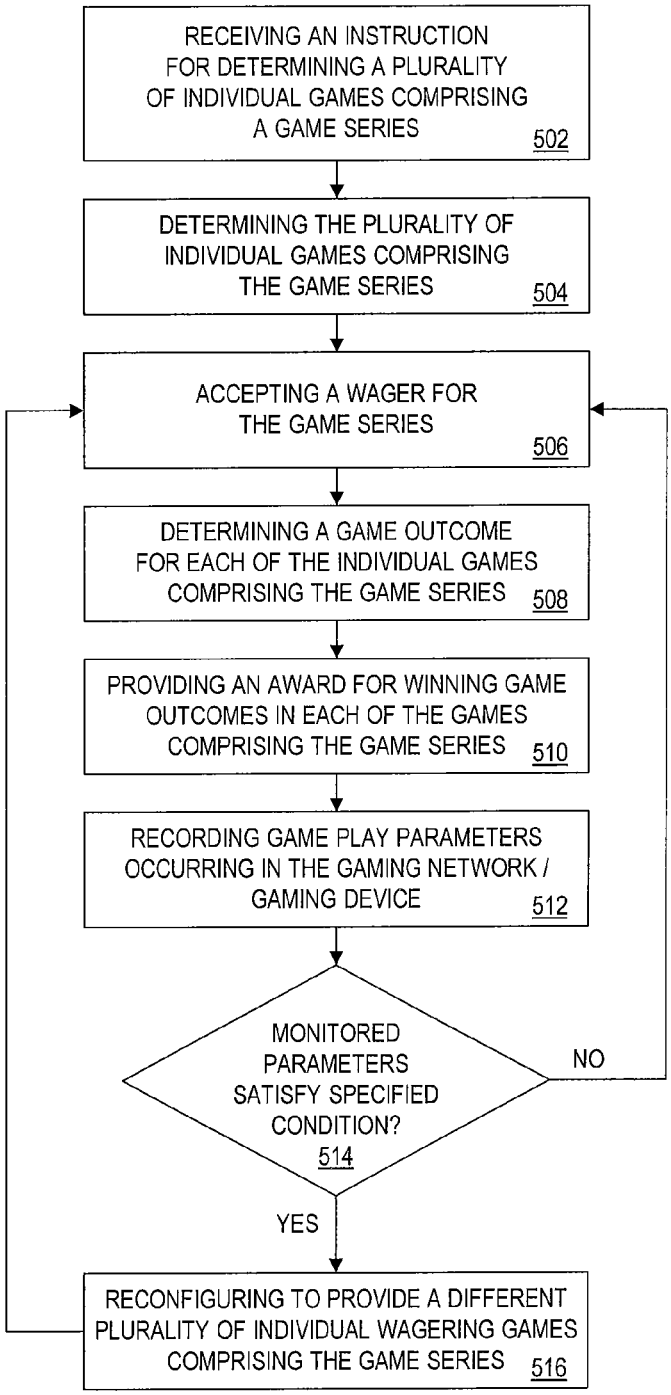
FIG. 5 is a flow chart of one embodiment of the process for triggering reconfiguration of a gaming device to change the individual wagering games comprising a game series.

The network, and gaming devices on the network, are now discussed in relation to the processes that this system and equipment can perform. Turning to FIG. 5, a flow chart 500 is provided that illustrates the overall process of one exemplary embodiment for the formation of a game series comprising a plurality of individual wagering games. The process of FIG. 5 may be applied, in one embodiment, to the gaming network 100 of FIG. 1 to illustrate the process flow in relation to the network devices 101.

The flow diagram of FIG. 5 is an exemplary embodiment of the formation of a first game series and the subsequent formation of a second game series. The process begins by first receiving an instruction for determining the plurality of individual games comprising a game series in step 502. This instruction is subsequently used to determine the plurality of individual games comprising the game series in step 504. To commence game play, a wager must be recognized on the game series (comprising a plurality of individual wagering games) in step 506. A game outcome for each of the individual wagering games comprising the game series is then presented sequentially to the player in step 508. An award is provided for a winning game outcome occurring in each of the individual wagering games in step 510.

Game play parameters (e.g., statistical game play results) are recorded reflecting game play occurring on the gaming device, and in some embodiments, on gaming devices in the entire computer network to which the gaming devices are connected in step 512. Each of the active conditions associated with instructions to trigger the reconfiguration of the gaming series (to comprise a different plurality of games) is then evaluated against the updated parameters database to determine if a reconfiguration has been triggered in step 514.

If no reconfiguration has been triggered in step 514, game play continues with the same individual wagering games that comprised the first game series in step 506. If, however, a reconfiguration has been triggered in step 514, an instruction is implemented for forming a new game series comprising a different plurality of individual wagering games in step 516. The player may then continue game play in step 506 by placing another wager. This process may continue for a plurality of game series until the player decides to either change the conditions and/or instructions for the selection of individual wagering games or until the player decides to end the gaming session.

Various embodiments and variations of the general flow process are possible. These embodiments include variations in the formation of game series, wagering on the game series, conditions and instructions for triggering reconfiguration, etc. These embodiments and variations are discussed in detail below.

Forming a Game Series from Individual Wagering Games

The flow process described above for creating a game series comprising a variety of different individual wagering games can be used in a number of different possible embodiments. All different types of wagering games, including all standard slot type games and video poker games may comprise the game series. Embodiments may also include not only single step type wagering games (such as a standard slot game where a one-step process selects a random number to determine a game outcome), but also multiple step games such as draw poker and the like. For example, in one embodiment, the individual wagering games may be single step wagering games, in another embodiment, all multiple step wagering games, and in a third embodiment, may comprise both single and multiple step wagering games comprising the game series.

In some embodiments, the outcome of the first game series determines a second game series based on predetermined conditions (e.g., conditions that are a function of the results obtained from the first game series). In other embodiments, the individual wagering games comprising the first game series and any subsequent game series may be individually selected by the player (either directly or indirectly) or automatically determined by the gaming device (based on operator specified conditions) or any combination thereof.

A stand-alone gaming device that operates independently of the server for determining a game series or a gaming device in cooperation with a gaming network may be used to implement certain embodiments. For example, turning back to FIG. 1, the gaming device may be configured to work in a gaming network 100. In this environment, the gaming device 102 and the gaming network 100 in which the gaming device is connected operate together to automatically determine a new game series (e.g., a gaming server 106 may assist in or otherwise determine a game series). Alternatively, the gaming device 102 may operate in a networked environment, yet only the gaming device determines the individual wagering games comprising the game series; other functions, such as player tracking, may be performed in conjunction with the network 100 and the gaming server 106.

The flexibility of the system to operate in a number of different configurations is enabled by the communication network 104, which allows any combination of database structures in either the gaming server 106 or the gaming device 102 to be implemented to effect the reconfiguration to present a new game series. The game play server, capable of collecting game play statistical data, may keep real-time information of game play statistics to enable a gaming device to execute the player's instructions for selecting individual wagering games for a game series. This database, in one embodiment, is continuously updated to track values of specific parameters occurring with respect to individual games on the network 100. In one embodiment, the parameters database 145 may be used to track and store parameters for multiple games. For example, the server 106, in some embodiments, may allow a gaming device 102 to access databases in the data storage device 124 to monitor the status of parameters and determine the individual games comprising a subsequent game series.

For example, turning to FIG. 1, the gaming server 106 may trigger the reconfiguration of gaming device 102 based on the parameters database 145 and the reconfiguration database 148 through the communication network 104. When a second game series is requested, the gaming device 102 is instructed by the server 106 to reconfigure the selection of individual games in the second game series. The gaming device 102 receives the instruction from the server 106 and either automatically implements the game series for the player, or offers the player an opportunity to accept or reject (or even ignore) the second determined game series.

Alternatively, the gaming device 102 in the gaming network 100 shown in FIG. 1 may be implemented with the database configuration shown in the block diagram of FIG. 2. FIG. 2, for example shows a data storage device 224 having a games database 227, a parameters database 246 and a reconfiguration database 229 that can operate together within the gaming device to provide statistical data that enables the automatic and/or manual selection of games comprising a series of games. The statistical data collected may, in one embodiment, only come from the one gaming device on which these databases are located. Although the quantity of data is more limited, it still can provide significant insight into the past game play operating history of the gaming device. These databases allow the gaming device to operate independently of the server 106 and to trigger the reconfiguration, separately and independently of the gaming network and the game server 106.

The gaming device 200 may be part of the gaming network, but the gaming device still triggers and controls the reconfiguration process that determines a game series comprising individual wagering games. Although the gaming device 200 may communicate with a server on the network, such communication is not necessary to reconfigure the gaming device in response to satisfying a predetermined condition. However, such communications may be useful for augmenting standard gaming device data processing functions such as accounting and player-tracking.

Depending on the network and gaming device configuration, tracked parameters may be specific to either the games played on a single gaming device 102, to multiple games played on different gaming devices 102 in the gaming network 100, to "types" of games (e.g., video poker or slots) played on one or more gaming devices 102 of the gaming network 100, and so on. The statistics may include win/loss ratios, maximum consecutive games lost, wager amounts, speeded game play, and generally, any statistic related to game play. These parameters may satisfy conditions that trigger reconfiguration to allow presentation of a revised game series with a different set of individual wagering games.

The discussion that follows details certain embodiments and examples of the types of parameters, conditions, and instructions that may be used in the triggering and reconfiguration of gaming devices.

Parameters

Parameters, in some embodiments, may represent data, statistics, values, or other information that may be tracked and stored in association with game play on one or more gaming devices, Parameters may, in some embodiments, be considered when determining whether a condition is satisfied for the selection of a new game for a subsequent game series.

For example, a database may store a variety of parameters, including, e.g., a current number of consecutive losses associated with game "A." Thus, in some embodiments, when determining whether a condition is satisfied (e.g., "Game "A" accumulates 10 consecutive losses"), a database of stored current parameters may be accessed (e.g., the database indicates that the gaming device has achieved nine consecutive losses, and therefore the condition is not satisfied, such that an associated instruction may not be performed).

Turning to FIG. 6, an example of a parameters database 600 in table form with exemplary entries is presented, in accordance with one embodiment. The parameters database may 600 comprise, for example, the parameters database 145 of FIG. 1 and/or the parameters database 246 of FIG. 2. Game play parameters 602 include any statistical or other information regarding game play that may be collected from a gaming device or any network device on the gaming network.

Parameters 602 may be used to form conditions that can trigger the reconfiguration of the game series (e.g., by changing the composition of games for an upcoming series). For example, the parameters database may contain the top five highest paying games, the most popular game by number of players, etc. Other potential parameters associated with individual games 610 include the number of consecutive losses or consecutive winning game outcomes obtained, win-to-loss ratio, financial return over a rate a time, financial return over a unit of time, rate of improvement in the financial return, improvement in the financial returned over a unit of time, the win-to-loss ratio, etc. These parameters may then form the basis for validating various conditions (which may be player-specified, programming into a machine or server by an operator or manufacturer, and so on) that can trigger the reconfiguration of the gaming device.

Conditions for Triggering Reconfiguration

A reconfiguration condition (or simply condition), in some embodiments, stipulates one or more terms, which must be satisfied in order for a reconfiguration instruction (or simply instruction) to be executed to develop a subsequent game series. For example, a condition may be "Wagering game A achieves X consecutive losses." Thus, upon wagering game "A" achieving X consecutive losses, an associated instruction may be performed (e.g., drop wagering game from next subsequent series of games and replace with wagering game "B").

In another example, a player may specify that certain game types may persist from series to series, while others may not (e.g., game "A" is to remain in every series while other individual wagering games may be randomly determined or otherwise subject to other conditions from series to series). Alternatively, a game in one embodiment is persistent only if a specified game outcome is achieved.

In other embodiments, all of the individual wagering games in a subsequent game series may be selected subject to conditions and instructions. For example, an individual wagering game may "persist" into a subsequent game series in the event a particular game outcome is achieved. In another example, a game may persist in the event a payout, or more specifically, a minimum payout is achieved in association with the individual wagering game.

In still another example, the history of the individual wagering game's performance may be evaluated to verify that a specified parameter is maintaining a minimum acceptable limit. For example, an individual wagering game must payout at least 95% over a period of game outcomes or a period time to persist into the subsequent game series. In another example, a replacement rule may be created which states, an individual wagering game is removed if it experiences 10 consecutive losses. In certain cases, a persistence rule may conflict with a replacement rule and a determination, or a rule, must exist to resolve the conflict. For example, in the sample provided above, an individual wagering game may experience greater than a 95% return yet experience 10 consecutive losses. In such an example, the replacement rule may trump the persistent rule.

Individual wagering games that do not persist into the subsequent game series (i.e., games that are replaced) require a selected replacement. Replacement games may be selected in the basis of player preferences such as whether a game is "hot" or "cold." In another embodiment, replacement games may be selected randomly.

Turning to FIG. 7, a game series reconfiguration database 700 is presented in tabular form with exemplary entries, in accordance with one example embodiment. The reconfiguration database may comprise, for example, the reconfiguration database 148 (FIG. 1) and/or the reconfiguration database 229 (FIG. 2). The game series reconfiguration database 700 lists conditions 712 that trigger an instruction 710 to create a subsequent game series comprising a different group of individual games. Conditions 712 may include, for example, winning 100 dollars in a minute, total number of players currently playing a game exceeds a threshold, and percentage of all players currently playing a game exceeds a threshold, etc. Additional example conditions 712 are shown in FIG. 7 that may trigger an instruction 710.

Other conditions may be developed centered around player game play tactics. Because wagering entails considerable superstition, players often desire a specific game from which to receive individual game outcomes. Accordingly, players may find statistical or other information useful in helping them decide which individual games they would like to specify for inclusion in a game series. For example, many players are interested in which games are doing well. Other players are very interested in games that are doing poorly. Players often associate games as "hot" when they experience significant wagering success. In contrast, players often associate games as "cold" when they do not have significant wagering success. In either case, different players will want to play hot or cold games. A list of conditions indicating cold and hot games are listed as follows.

A game may be considered "cold" when:

- Game has paid out less than a threshold percentage of coin-in (wagers placed) for a duration of time or game plays (e.g., less than 50% of coin-in during past hour)
- Game has paid out less than a threshold number of total coins for a duration of time or game plays (e.g., less than 10,000 coins in the last month)
- Net loss amount (amount wagered minus amount won) exceeds threshold for a duration of time or game plays
- Game is currently being played by less than a threshold percentage of players on the floor (e.g., less than 5% of players on floor)
- Game is currently being played by less than a threshold total number of players (e.g., less than 15 players)
- More than threshold number of losing outcomes for a duration of time or game plays
- Less than threshold number of winning outcomes for a duration of time or game plays
- More than threshold number of consecutive losing outcomes
- Less than threshold number of consecutive winning outcomes
- Percentage of all outcomes that are losses exceeds threshold for a duration of time or game plays
- Credit balance is equal to or lower than a threshold number
- Current credit balance is lower than a threshold percentage of buy-in amount A game may be considered "hot" when:

- Game has paid out more than a threshold percentage of coin-in (wagers placed) for a duration of time or game plays (e.g., more than 100% of coin-in during past hour)
- Game has recently paid a single payout of more than a threshold number of coins
- Game has paid out more than a threshold number of total coins for a duration of time or game plays (e.g., more than 1,000 coins in the last hour)
- Net win amount (amount wagered plus amount won) exceeds threshold for a duration of time or game plays
- Game is currently being played by more than a threshold percentage of players on the floor (e.g., more than 10% of players on floor)
- Game is currently being played by more than a threshold total number of players (e.g., more than 30 players)
- Less than threshold number of losing outcomes for a duration of time or game plays
- More than threshold number of winning outcomes for a duration of time or game plays
- Less than threshold number of consecutive losing outcomes
- More than threshold number of consecutive winning outcomes
- Percentage of all outcomes that are wins exceeds threshold for a duration of time or game plays
- Credit balance is equal to or greater than a threshold number Another type of condition measures the popularity of the game or gaming device. Some players desire to play the most popular game or gaming device 200 in the gaming establishment. To facilitate this desire, the game series may include a wagering game fulfilling one of the following conditions:

total wager amount exceeds a threshold for duration of time or game plays;

total number of game plays exceeds a threshold; and total time spent playing game exceeds a threshold.

Consequently, any number of conditions may be established related to the statistics associated with an individual game at a gaming device, or to a compilation of game play statistics associated with a game provided on a computer network to multiple gaming devices. These conditions when validated by current parameter data may then be used to reconfigure the gaming device according to instructions specified by the player or the gaming device.

Generally, from the description provided above, in one embodiment, determining if a condition is satisfied may comprise: (i) accessing a reconfiguration database to determine whether the condition is active, (ii) accessing a parameters database to determine a current parameter, and (iii) determining whether the condition is satisfied based on the parameter.

For example, turning back to FIG. 1, a gaming server 106 may access a reconfiguration database 148 after each game play of each gaming device connected thereto. The server 106 may determine that a reconfiguration condition associated with game "A" is currently active. The condition, as indicated by the reconfiguration database 148 may be "10 consecutive losses occur on Game A" (with the associated instruction being "Switch from Game A to Game B"). Accordingly, the server 106 may access a parameters database 145 to determine a number of consecutive losses associated with game "A." If the number is equal to (or greater than) 10, it may be determined that the condition is satisfied.

The individual wagering games in a game series may be assigned to specific positions on the video display. A game that "persists" from a first series to a second series may maintain that position on the video display. If desired, rather than examining each of the individual wagering games in a game series, each of the different positions on the video display may be associated with various parameters that may be evaluated to determine the persistence of the game in that position. Consequently, rather than evaluating all of the individual wagering games displayed to determine their relative individual ranking, the positions of the individual games in the game display become determinative of the persistence of that game, in that specific position, into the following game series.

In contrast, another embodiment uses the position of each of the individual wagering games to denote the relative success of each different individual wagering game in the game series. For example, the individual wagering game with the greatest payback percentage may be placed first in order to the smallest payback percentage (e.g., from top to bottom, or left to right, to indicate the best performing game to worst-performing game). Each of the individual wagering games will constantly shift position from game series to game series while new games are added to replace games that are not adequately performing to satisfy specified conditions.

As can be appreciated from the above discussion, any number of conditions may be created related to game play, players, gaming devices, equipment availability, promotions, competitive game play, collaborative game play, etc. that may be constructed, singly or in combination, to detect game play, player, or network related conditions or otherwise facilitate play on gaming devices. These conditions may then be used to trigger the implementation of an instruction to reconfigure the game series as discussed below.

Instructions for Reconfiguring a Game Series

A reconfiguration instruction (or simply instruction) in some embodiments, is an instruction that may represent an action, which may be performed upon the satisfaction of an associated condition. For example, an instruction may be to change one of the games in the series (or all of the games in the series).

In some embodiments, an instruction to determine the individual games comprising a second game series may be received from a player, operator, manufacturer, or other person. Instructions may be stored in a database and associated with conditions that trigger the reconfiguration of the game series.

A variety of different types of instructions governing the reconfiguration of a gaming device are possible. A database of example instructions and the corresponding example condition(s) under which those instructions are implemented is shown in reconfiguration database 700 of FIG. 7. The reconfiguration database 700 may comprise, for example, the reconfiguration database 148 of FIG. 1 and/or the reconfiguration database 229 of FIG. 2. If it is determined that a condition is satisfied, a game series may be reconfigured based on an associated instruction indicated by the reconfiguration database.

In general, the instructions 710 in the reconfiguration database 700 of FIG. 5 can be generalized as switching from a first game to a second game. Upon the satisfaction of a condition (e.g., "10 consecutive losses"), the instruction 710 specifies a reconfiguration activity to alter game play. A player might select this instruction to discard "cold" games in the hopes of finding a better paying game. Upon the satisfaction of a condition, the gaming device presents the new game to the player. For example, the first game may be blackjack, the second game may be video poker, and the player may be automatically switched from the blackjack game to the video poker game.

The change in game play from the first game to the second game may be subtle. For example, the first game may be blackjack and the second game may be a form of the original blackjack game. The difference might be, for example, the number of wild cards in the deck, the number of decks used in the game play, etc. As another example, a poker game may require "Jacks or Better" for a period of time which upon contingent of the occurrence of a condition changes to "Quadruple Royal Flush Jacks or Better." In other words, in some embodiments, one or more elements that distinguish a first game from a second game may be altered, including graphics (e.g., a "skin" of a game), sounds, active pay combinations or probabilities, payout amounts, and so on.

Multiple Active Instructions/Conditions

Although the discussion above has generally been limited to specifying a single condition and instruction, it is possible to have multiple conditions and instructions, all currently active, which may determine a subsequent game series. In some embodiments, more than one instruction 710 and/or condition may be active and ready to implement (e.g., concurrently). For example, the player may select an instruction 710 to "switch to game B" on the condition that "$100 or more is lost on game A." The player may also select, concurrently, the instruction to "switch to game C" on the condition of "10 consecutive losses on game A." The first condition that enables the instruction is carried out.

As conditions 712 for each of these instructions 710 is satisfied, change in game play is implemented. Having the ability to specify multiple conditions 712 and instructions 710 allows the player to customize game play more precisely.

Wagering on a Game Series

The number of individual wagering games comprising the game series may be fixed by the game (e.g., 10 individual wagering games), a randomly determined variable number of individual wagering games (e.g., between five and ten individual wagering games), or specified by a player.

In embodiments with a predetermined number of individual wagering games, each individual wagering game may have an associated wager amount, with the player placing a single wager for the sum of the wagers required by each of the individual wagering games to procure the game series. Alternately, a predetermined wager may be associated with a game series. In some embodiments, a series may comprise one or more games that are not wagered on (e.g., a series comprises five games, but a player only wagers on four, such that one series is being watched for entertainment purposes only).

In embodiments having a player-determined number of individual wagering games, the player may again pay an individual wager associated with each of the individual wagering game selected. For example, wherein the player has selected 10 individual wagering games, each of the individual wagering games may require a 1-credit wager, and the player provides 10 credits for the block of 10 individual wagering games that creates the game series (though it should be understood that a player may wager various inconsistent amounts on different individual games of a series, such as two coins on a first game, five coins on a second game, and so on).

Alternatively, a player may place a predetermined single wager for a game series comprising of a randomly selected number of individual wagering games. The gaming device randomly determines the number of individual games awarded to the player (e.g., between five and 10 individual wagering games). This creates a hierarchical game play mechanic with multiple potentially winning game stages from the beginning to the end of game play. In this case, the first stage may allow winning more playable games than anticipated, providing the player with additional chances to produce winning game outcomes in a subsequent stage when the game outcomes are determined for each of the individual games.

In one embodiment, a player may place a wager that may be allocated across a randomly (or semi-randomly) determined number of games of a series. For example, a player may post a 20 credit wager on an upcoming series, thought the individual number of games the series comprises may be unknown by the player until the series is executed. Thus, in one embodiment, a gaming device (or server) may first determine a total payout amount for the series, and then allocate the payout across individual games of the series (e.g., if a total payout is 10 coins, a first game pays two coins and a fourth game of the series pays eight coins). In some embodiments, such sub-payout amounts may be in fractions of coins, such that they add together to form an even number. In some embodiments, the allocation of payouts across multiple composite games of series may be done in a strategic manner in an attempt to heighten the player's enthusiasm, increase suspense (e.g., large payouts held until the end), and so on.

Regardless of how the individual wagering games are priced in the game series, the game series may be purchased as a block of games. Further, a block of block games may also be purchased. Methods for establishing flat rate playing sessions are described in Applicant's U.S. Provisional Patent Application Ser. No. 60/627,670, filed on Nov. 12, 2004 and entitled GAMING DEVICE OFFERING A FLAT RATE PLAY SESSION AND METHODS THEREOF"; U.S. Provisional Patent Application Ser. No. 60/679,138 filed on May 9, 2005 and entitled SYSTEMS, METHODS, AND APPARATUS FOR FACILITATING A FLAT RATE PLAY SESSION ON A GAMING DEVICE; the content of each application hereby incorporated by reference in its entirety.

Selecting Individual Wagering Games

In one embodiment, the initial game series and all subsequent game series may be determined based on measured game play parameters and instructions for determining the composition of a game series. In another embodiment, the initial games are selected by the player and all subsequent game series are automatically determined based on satisfied conditions. In some embodiments, a player may have an option to determine the composition of a game series at any point. In an alternate embodiment, the individual wagering game selected may be selected on a purely random basis.

In some embodiments, the initial determination of a game series comprising the selection of a plurality of different individual wagering games may be manually performed by the player. In some embodiments, the player may indirectly select the individual games comprising the initial game series through the specification of the attributes of the individual games that will comprise the game series. For example, the player may specify that each of the different individual wagering games comprising the initial game series must have the greatest payback percentages in the last hour of all the available games. In some embodiments, players may be shown a menu of available games from which they may select games to populate one or more "upcoming" series (e.g., by dragging and dropping an icon representing a game into a "position" of an upcoming series).

Subsequent game series may be automatically determined (partially or wholly) as a function of predetermined conditions that are generally dependent upon game play parameters. The predetermined conditions and tracking of current game play parameters allow new game series to be created seamlessly—without the need for player intervention in the selection of the individual games comprising the game series. In another embodiment, even the individual wagering games in the initial game series may be determined automatically.

The predetermined conditions that may modify (or select) the first game series may be specified by the player. For example, in some embodiments, a menu may be presented to the player that lists a number of selectable conditions that will alter the selection of individual games comprising subsequent game series. The gaming device itself automatically determines the individual games comprising subsequent game series that are presented to the player (and, in some embodiments, the initial individual games comprising the first game series).

The conditions that trigger changes in the individual wagering games in the game series may be related to the player's game play (e.g., the success of the player, etc.). In some embodiments, conditions that trigger changes in game play may also be related to another player's game play results. For example, the automatic determination of a subsequent game series may be triggered by conditions requiring the selection of the "hottest" or the "coldest" game in the gaming establishment, the most successful player, etc.

Using the features and methods described herein, the player has a means to indirectly or directly specify the games the player may be most interested in playing. This allows the gaming device to present a game series to the player that automatically changes the individual wagering games comprising the game series during each subsequent play of a game series at the gaming device.

Figure 8:
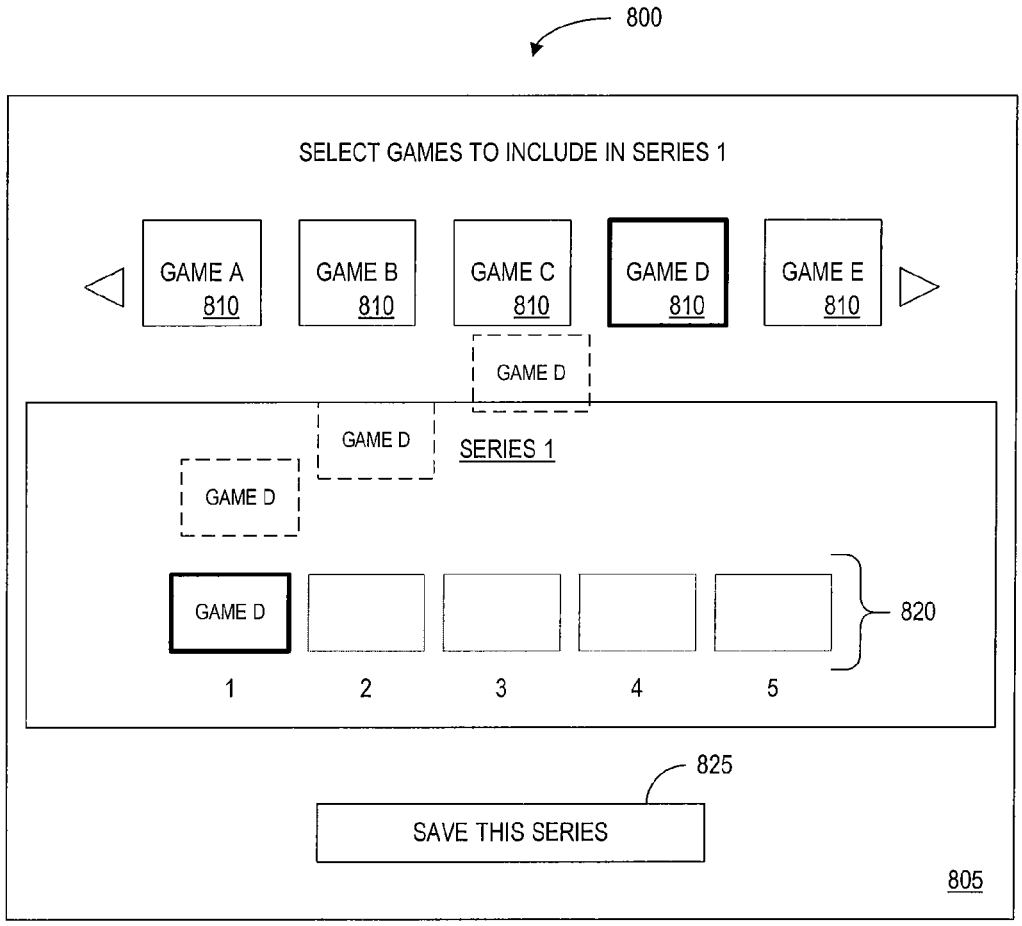
FIG. 8 is an exemplary embodiment of a video display of a gaming device illustrating an example of the initial selection of the individual wagering games comprising a game series.

In the embodiment that allows the player to initially select the individual wagering games, the player may make selections from a menu for the first game series or any other subsequent game series. Turning to FIG. 2, in some embodiments, players may, specify instructions and conditions on the gaming device 200 through the player-tracking device 260 or through one of the video displays (i.e., the primary video display 234 or secondary video display 238). For example, FIG. 8 illustrates one exemplary embodiment of a game video display 800 having a plurality of individual wagering games 810 that may be selectable by the player to create a game series 820 available as a block purchase.

Players may select individual wagering game icons using a touch screen to indicate selected games. Alternatively, players may use the touch screen 805 to select an individual game 810 and drag it to an appropriate area for collection in a game series. Sufficient individual wagering games 810 may be available that prevents all of the games from being displayed simultaneously, in these circumstances, individual wagering games may be scrolled to allow a player to see all the possible selections. Individual wagering games 810 may also be classified according to game type. For example, a number of different poker games exist that all may be classified as poker type games, facilitating the selection of such games.

Further, players may identify one or more series from a plurality of "upcoming" series, and the determine the composition of game for the identified series (e.g., players may access a screen showing the composition of a plurality of upcoming series, such that one series may be selected).

In another alternative embodiment, the gaming device and the player may both make selections of the individual wagering games 810 comprising the game series 820. Finally, the player may select instructions that determine the individual wagering games presented in the game series.

In still another embodiment, rather than making individual selections of wagering games, the player, or the gaming device in some embodiments, may select the parameters, conditions, and instructions that determine each of the individual wagering games that comprise a game series.

In some embodiments, instructions and conditions may be selectable from a list or menu of available instructions and conditions. The instructions for reconfiguring the game series may be entered/selected by a player or operator by using a gaming device, a server, or computing device in communication with the gaming device (e.g., an operator uses a personal computer device in communication with a server to select/activate instructions and/or conditions), a kiosk, and so on.

In one embodiment, a player/operator may select an instruction or condition (e.g., instruction to select a particular individual game for a second game series), and then enter various desired values in association with the selected type of instruction or condition (e.g., the player uses an input device to specify a desired number of consecutive wins which determine when that individual game is provided in a subsequent game series).

An illustration of such an embodiment is shown in FIG. 9, which depicts a video display 900 having a touch screen 905 that enables the player to select conditions and instructions for the formation of a game series from a menu 910. The conditions 920 that trigger the instructions 930 are displayed. A player may activate these conditions and instructions using the touch screen 905, which then indicates the status of the condition 940. This video display may be used to select all of the game series or, it may be applicable to only subsequent game series after the initial games comprising the first game series have been manually selected.

The player may decide to change conditions or instructions between game series. These instructions/conditions may be deactivated or adjusted, for example, using the touch screen and touching the condition the player wishes to deactivate or adjust. For example, as conditions are toggled off, a red "X" (or the international "prohibited" symbol) may appear above the indication of the condition. The player may also cancel an instruction during a window of opportunity immediately after a condition has been satisfied to prevent the reconfiguration. For example, "Switching to game B in five . . . four . . . three . . . —touch here to cancel switch."

Turning to FIG. 1, players may, in some embodiments, also customize player instructions on the gaming network 100 using one of many possible network devices 101 other than the gaming device. For example, an Internet linked personal computer 121 may use a gaming establishment's web site to specify instructions. A player might, in one embodiment, customize instructions and/or conditions by using a gaming establishment's Web site (e.g., such that the instructions/conditions are stored in a database maintained with a gaming establishment, such that when the player arrives at the gaming establishment and inserts a player tracking card, or otherwise provide identification, the gaming device may reconfigure based on the instructions/conditions previously provided online).

Alternately, a kiosk 110 in the gaming establishment may be used to specify instructions. Portable handheld devices 120 (including wireless devices such as PDAs and cellular telephones) may also be used, in some embodiments, to send instructions/conditions to the gaming server 106.

A player may also request, in some embodiments, that various settings or preferences, conditions and instructions, may be stored (e.g., as a record of a database maintained within the memory of a gaming device 102 and/or server 106). In some embodiments, instructions may be retrieved with the player's player-tracking card identification number (e.g., a PIN or a smart card, biometric identifier, etc.). In this manner, a player's preferences or condition/instructions may follow the player from gaming device to gaming device as a player moves through the gaming establishment to play different games, or play in different locations within the gaming establishment.

Reminders may be displayed on the gaming device display to remind players of the instructions/conditions that have been set that may affect game play. In addition, the parameters that determine whether these conditions are met may also be displayed with their current values and with the triggering points that satisfy the condition. For example, if a player is playing Game A and an instruction is to switch to Game B upon the condition of 10 consecutive winning outcomes of Game B, an indication of the "current number of consecutive winning outcomes for Game B" might be presented to the player. For example, the reminder might be providing the message "switching to Game B in nine more losses." Accordingly, should a player desire to revise such an instruction as game play continues, the player may access an appropriate screen to do so.

Methods for customizing gaming devices are described in Applicant's U.S. Pat. No. 6,068,552, filed Mar. 31, 1998, entitled "A GAMING DEVICE AND METHOD OF OPERATION THEREOF;" U.S. Pat. No. 6,110,041, filed Dec. 30, 1996, entitled "METHOD AND SYSTEM FOR ADAPTING GAMING DEVICES TO PLAYING PREFERENCES;" and U.S. application Ser. No. 10/361,201, filed Feb. 7, 2003, entitled "A GAMING DEVICE AND METHOD OF OPERATION THEREOF," the entirety of each are incorporated herein by reference for all purposes.

Once the games series has been selected, either directly or indirectly by the player, the gaming device is now prepared to determine the game outcomes for each of the individual wagering games in the series once a "start" button is actuated by the player (or similar button, such as "spin," "play series," etc.).

Figure 10:
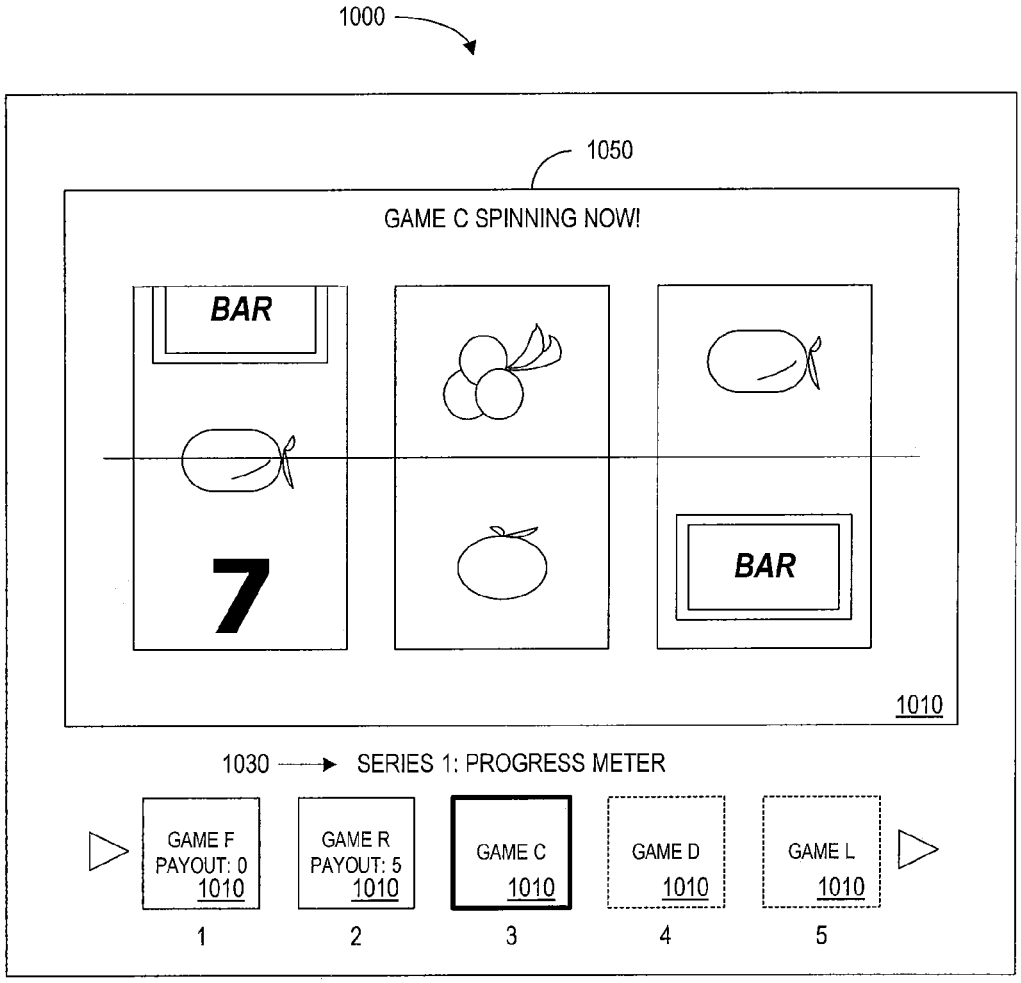
FIG. 10 is an exemplary embodiment of a video display illustrating an example of one of the games in a game series being readied for display.

Turning to FIG. 10, a video display 1000 of a game device is in the process of sequentially determining the outcome for each individual wagering game 1010 in the game series. In this illustration, the game outcomes are sequentially displayed to the player on the video display of the gaming device.

To increase anticipation, there may be a slight delay between the displays of game outcomes between individual wagering games 1010. The time delay between displayed game outcomes may be used to introduce the next individual wagering game in the game series. Additionally, during this time, a credit meter balance may update to reflect changes based on payouts/wagers. The game outcome of each individual wagering game is featured sequentially in a game display area 1050.

In addition, a progress meter 1030 may highlight the current game along a time line indicating all of the individual wagering games in the game series. A game meter may be provided to display the results of each game outcome (e.g., credits won).

Each individual wagering game may be displayed in a predetermined order. The order may be determined by the gaming device or by the player, either randomly or based on a programmed instruction. For example, in one embodiment the game outcomes may be displayed randomly. In another embodiment, the order the in which the game was selected (either by the player or automatically by the gaming device) may determine the order of the presentation of game outcomes. In still another embodiment, the gaming device may automatically order the display of game outcomes.

For example, the game device may determine the game outcome of each individual game, and display the losing game outcomes first and the winning game outcomes in order from the smallest to the largest award. This particular technique builds player anticipation and adds entertainment value.

In still another embodiment, the gaming device may attempt to provide the game outcomes in a relatively level manner interspersing winning game outcomes with losing game outcomes. For example, winning game outcomes may be alternated with losing game outcomes.

The ordered presentation is of course possible by predetermining the random game outcomes for each of the individual wagering games comprising the game series. The order of presentation of each game outcome is then determined.

Figure 11:
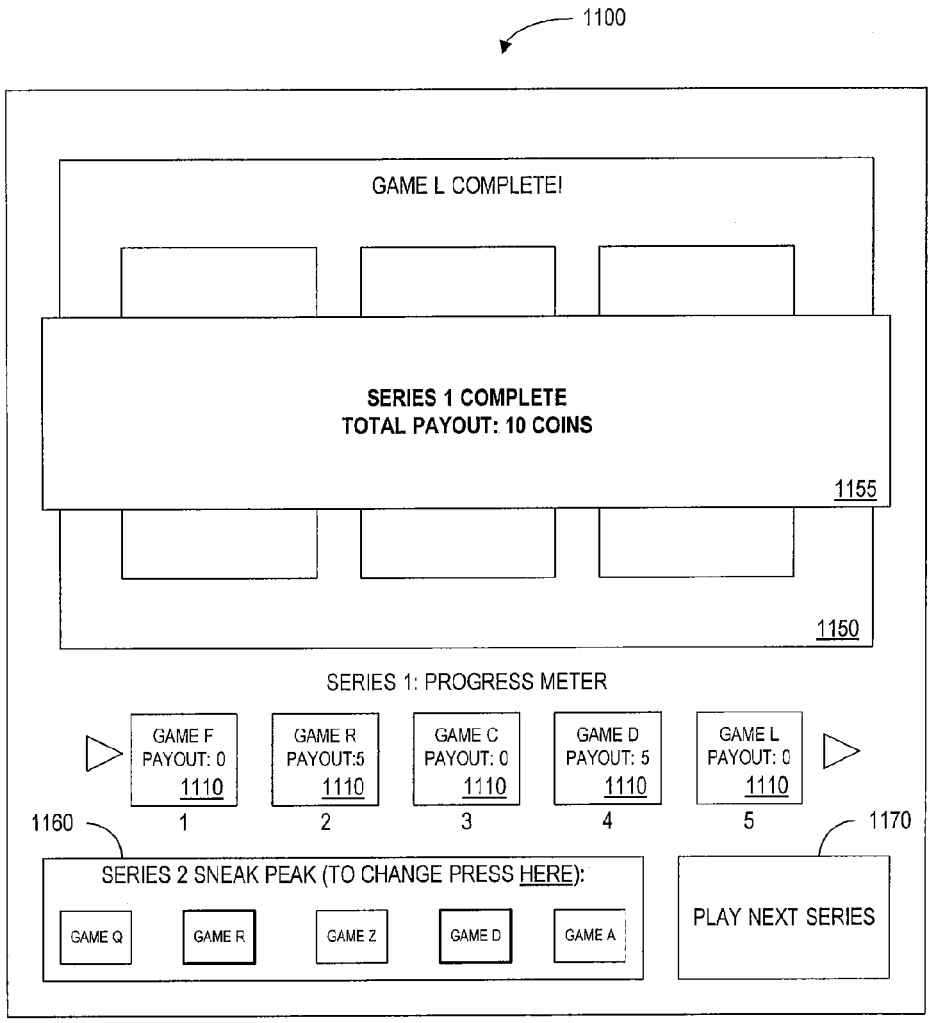
FIG. 11 is an exemplary embodiment of a video display illustrating an example of the completion of the game series.

In some embodiments, the player may have wagered on a plurality of game series. For example, the player may have purchased or otherwise indicated a desire to play 10 game series, each game series comprising 10 individual wagering games. Each of the subsequent game series, potentially evolving to comprise different sets of individual wagering games. These game series may be played sequentially until all the game series are completed, in some embodiments, with a single button actuation. The order in which each of the game series are selected for play can also be player customized. Alternatively, similar to the ordering of the individual wagering games for display, each of the different games series may also be ordered, Consequently, each of the 100 games comprising the 10 games series may be presented in any desired order determined by the gaming device Turning to FIG. 11, a presentation 1155 is illustrated at the end of the game series to recap a summary of the game series including the individual wagering games 1110 won, games lost, wager amounts, award amounts, etc. In some embodiments, such a presentation is optional (e.g., may be omitted entirely or may only be shown upon player request). The individual wagering games comprising the individual wagering games comprising the next game series 1160 may be presented to the player. To receive the next game series the player may actuate the start pushbutton 1170.

Operator Determined Selections

The operator of the gaming establishment, in one embodiment, may also determine criterion under which the individual wagering games comprising a game series may be switched, with or without an offer to make this switch. Switching the individual wagering games may be provided as part of a promotional service or part of an effort to increase the entertainment value of the gaming experience.

For example, conditions may be determined that indicate the player has become bored with the game. These may comprise different conditions such as: 1) time spent playing greater than 1 hour, 2) less than 10 game plays initiated within 5 minutes, and 3) losing more than 5 dollars in 5 minutes. Satisfaction of all three conditions may be required to indicate boredom, or any other combination, or even single condition may be used to indicate boredom.

In one embodiment, if it is determined that all three of these conditions are satisfied. The reconfiguration may select different games to create a new game series to increase player interest in the game. The implementation of such a new game series may be preceded by an offer from the gaming establishment to allow the player to determine whether the implementation should be allowed.

In other situations, the player may want to provide promotions to award players special bonus games for their patronage. These bonus games may have a superior payback percentage, or other similar features that change the gaming experience. For example, an entire game series may be composed of individual wagering games with superior payback percentages as a bonus event provided to the player.

Alternatively, the gaming establishment may decide, based on a satisfied condition, to award a player with a free game, added to the next purchased game series. The player may be anticipating a game series with five individual wagering games, and instead, is provided with a sixth bonus game free of charge.

Players may also be switched to other games as part of promotional activities to advertise new games as well as games that are underutilized. Promotional activities may include offers of free game plays, etc. By switching players into such games, players may experience the game for free or at greatly reduced cost, allowing the gaming establishment to promote the game. Because the gaming establishment is controlling the switch (or at least the offer) from the current game into the promotional game, the gaming establishment can also control the timing of the promotion's termination and return the player to standard wagering games. This allows the gaming establishment to control losses incurred with special promotional game offers.

Another example of a gaming establishment specified instruction is, to some extent, an incomplete player specified instruction. For example, the player may not have any preference regarding the instructions/conditions for switching games or the games to which the player is switched. For example, the player may specify, "Let the casino control my fate." The player may register this as a preference for a period of time or number of game plays (e.g., "Let the casino control what games I play for next 10 spins"). Thus, in one embodiment a player may repeatedly trigger the execution of a "quick pick" type of series (much like allowing a lottery service to randomly select a group of numbers that will be played), the contents of which are randomly determined and/or determined based on operator-specified instructions/conditions.

Operator Offers for Special Game Series

In some embodiments, players may be presented with offers to switch to different games—rather then automatically implementing reconfiguration of the gaming device. For example, when the condition specified is satisfied, rather than implementing the instruction, an offer is first made to the player to implement the instruction. The player may then decline or accept the offer. The player may accept offers through the touch screen display or potentially through the pushbutton panel.

Offers may be permanent or transitory on the gaming device display. Transitory offers may last for a predetermined number of game plays, for a predetermined period of time, etc.

To accept an offer, players may provide input via the touch screen, pushbutton on the pushbutton panel, or through the player-tracking device. Accepting the offer has the effect of altering the game play per the offer's instructions.

Conclusion

Although the foregoing described only a few of the most popular wagering games to which reconfiguration can be applied, it should be appreciated that any type of wagering game implemented can be reconfigured when a condition is satisfied to implement a new game series. Further, these gaming devices are not limited to the embodiments described (i.e., video gaming devices, such as video slot machines and video poker machines), but can also be applied to other types of gaming devices, such as video roulette machines, video blackjack machines and the like. Furthermore, it is also possible to employ electro-mechanical gaming devices such as gaming devices with mechanical reels that determine game outcomes as another embodiment that may use the methods and apparatus discussed herein.

Thus, while the present invention has been described in terms of certain embodiments, other embodiments that are apparent to those of skill in the art are also intended to be within the scope of the present invention. Accordingly, the scope of the present invention is intended to be limited only by the claims appended hereto.

The invention is claimed as follows:

1. A method of operating a gaming system, said method comprising:

(a) receiving an indication of a first series of wagering games of a plurality of different wagering games from a first player of a gaming device, the first series of wagering games including a first quantity of at least two of the plurality of wagering games and having a respective first play order;

(b) causing at least one processor to execute a plurality of instructions stored in at least one memory device to select a second different series of wagering games of the plurality of wagering games, the second different series of wagering games including a second quantity of at least two wagering games and having a second play order;

(c) causing the at least one processor to execute the plurality of instructions to identify at least one condition and a respective threshold;

(d) enabling the first player to play the wagering games of the first series according to the first play order and causing the at least one processor to execute the plurality of instructions to operate with at least one display device to display an outcome of each played wagering game of the first series;

(e) causing the at least one processor to execute the plurality of instructions to monitor the identified at least one condition to determine if the at least one condition meets the respective threshold by, at least in part, monitoring wagering game activity; and (f) if the monitored at least one condition meets the respective threshold, causing the at least one processor to execute the plurality of instructions to stop play of the wagering games of the first series and enabling the first player to play the wagering games of the second different series.

2. The method of claim 1, wherein causing the at least one processor to execute the plurality of instructions to monitor the identified at least one condition to determine if the at least one condition meets the respective threshold includes causing the at least one processor to execute the plurality of instructions to monitor other wagering game activity.

3. The method of claim 2, wherein causing the at least one processor to execute the plurality of instructions to monitor other wagering game activity includes at least one of:

(a) causing the at least one processor to execute the plurality of instructions to monitor occurrences of winning outcomes of at least one other player of other wagering games;

(b) causing the at least one processor to execute the plurality of instructions to monitor occurrences of losing outcomes of the at least one other player of the other wagering games;

(c) causing the at least one processor to execute the plurality of instructions to monitor occurrences of winning payout amounts of the at least one other player of the other wagering games;

(d) causing the at least one processor to execute the plurality of instructions to monitor a winning outcome percentage of the at least one player of the other wagering games;

(e) causing the at least one processor to execute the plurality of instructions to monitor a losing outcome percentage of the at least one player of the other wagering games;

(f) causing the at least one processor to execute the plurality of instructions to monitor a ratio of winning outcomes to losing outcomes, over a finite period of time, for a second player, the second player playing on a gaming device different from that of the first player;

(g) causing the at least one processor to execute the plurality of instructions to monitor a ratio of winning outcomes to losing outcomes, over a predetermined number of game plays, for the second player;

(h) causing the at least one processor to execute the plurality of instructions to monitor a number representing consecutive winning outcomes for the second player;

(i) causing the at least one processor to execute the plurality of instructions to monitor a number representing consecutive losing outcomes for the second player; and (j) causing the at least one processor to execute the plurality of instructions to monitor a number representing a difference between an amount wagered and an amount paid for the second player.

4. The method of claim 1, wherein causing the at least one processor to execute the plurality of instructions to monitor the identified at least one condition to determine if the at least one condition meets the respective threshold includes causing the at least one processor to execute the plurality of instructions to monitor outcomes of the plays of the wagering games of the first series.

5. The method of claim 1, wherein causing the at least one processor to execute the plurality of instructions to monitor the identified at least one condition to determine if the at least one condition meets the respective threshold includes at least one of:

(a) causing the at least one processor to execute the plurality of instructions to monitor a ratio of winning outcomes to losing outcomes, over a finite period of time, for the first player;

(b) causing the at least one processor to execute the plurality of instructions to monitor a ratio of winning outcomes to losing outcomes, over a predetermined number of game plays, for the first player;

(c) causing the at least one processor to execute the plurality of instructions to monitor a number representing consecutive winning outcomes for the first player;

(d) causing the at least one processor to execute the plurality of instructions to monitor a number representing consecutive losing outcomes for the first player; and (e) causing the at least one processor to execute the plurality of instructions to monitor a number representing a difference between an amount wagered and an amount paid for the first player.

6. The method of claim 1, which is provided through a data network.

7. The method of claim 6, wherein the data network is an internet.

8. A gaming system comprising:

at least one processor;

at least one display device;

at least one input device; and at least one memory device storing a plurality of instructions which, when executed by the at least one processor, cause the at least one processor to operate with the at least one display device and the at least one input device to:

(a) receive an indication of a first series of wagering games of a plurality of different wagering games from a first player of a gaming device, the first series of wagering games including a first quantity of at least two of the plurality of wagering games and having a respective first play order;

(b) select a second different series of wagering games of the plurality of wagering games, the second different series of wagering games including a second quantity of at least two wagering games and having a second play order;

(c) identify at least one condition and a respective threshold;

(d) enable the first player to play the wagering games of the first series according to the first play order and display an outcome of each played wagering game of the first series;

(e) monitor the identified at least one condition to determine if the at least one condition meets the respective threshold by, at least in part, monitoring wagering game activity; and (f) if the monitored at least one condition meets the respective threshold, stop play of the wagering games of the first series and enabling the first player to play the wagering games of the second different series.

9. The gaming system of claim 8, wherein the plurality of instructions, when executed by the at least one processor, cause the at least one processor to monitor the identified at least one condition to determine if the at least one condition meets the respective threshold by monitoring other wagering game activity.

10. The gaming system of claim 9, wherein monitoring other wagering game activity includes at least one of:

(a) monitoring occurrences of winning outcomes of at least one other player of other wagering games;

(b) monitoring occurrences of sing outcomes of the at least one other player of the other wagering games;

(c) monitoring occurrences of winning payout amounts of the at least one other player of the other wagering games;

(d) monitoring a winning outcome percentage of the at least one player of the other wagering games;

(e) monitoring a losing outcome percentage of the at least one player of the other wagering games;

(f) monitoring a ratio of winning outcomes to losing outcomes, over a finite period of time, for a second player, the second player playing on a gaming device different from that of the first player;

(g) monitoring a ratio of winning outcomes to losing outcomes, over a predetermined number of game plays, for the second player;

(h) monitoring a number representing consecutive winning outcomes for the second player;

(i) monitoring a number representing consecutive losing outcomes for the second player; and (j) monitoring a number representing a difference between an amount wagered and an amount paid for the second player.

11. The gaming system of claim 8, wherein the plurality of instructions, when executed by the at least one processor, cause the at least one processor to monitor the identified at least one condition to determine if the at least one condition meets the respective threshold by monitoring outcomes of the plays of the wagering games of the first series.

12. The gaming system of claim 8, wherein monitoring outcomes of the plays of the wagering games of the first series includes at least one of:

(a) monitoring a ratio of winning outcomes to losing outcomes, over a finite period of time, for the first player;

(b) monitoring a ratio of winning outcomes to losing outcomes, over a predetermined number of game plays, for the first player;

(c) monitoring a number representing consecutive winning outcomes for the first player;

(d) monitoring a number representing consecutive losing outcomes for the first player; and (e) monitoring a number representing a difference between an amount wagered and an amount paid for the first player.

13. A method of operating a gaming system, said method comprising:

(a) receiving an indication of a first series of wagering games of a plurality of different wagering games from a first player of a gaming device, the first series of wagering games including a first quantity of at least two of the plurality of wagering games and having a respective first play order;

(b) causing at least one processor to execute a plurality of instructions stored in at least one memory device to select a second different series of wagering games of the plurality of wagering games, the second different series of wagering games including a second quantity of at least two wagering games and having a second play order;

(c) receiving a first wager from the first player, the first wager being associated with play of the first series of wagering games;

(d) after receiving the first wager, enabling the first player to play the wagering games of the first series of wagering games in the first play order;

(e) during play of the wagering games of the first series of wagering games, causing the at least one processor to execute the plurality of instructions to:

(i) operate with at least one display device to display an outcome for each played wagering game of the first series of wagering games, and (ii) monitor wagering game activity to determine whether at least one condition has been met; and (f) if the at least one condition has been met:

(i) receiving a second wager from the first player; and (ii) after receiving the second wager from the first player, enabling the first player to play the wagering games of the second series of wagering games in the second play order.

14. The method of claim 13, wherein causing the at least one processor to execute the plurality of instructions to monitor wagering game activity to determine whether the at least one condition has been met includes causing the at least one processor to execute the plurality of instructions to monitor other wagering game activity.

15. The method of claim 14, wherein causing the at least one processor to execute the plurality of instructions to monitor other wagering game activity includes at least one of:

(a) causing the at least one processor to execute the plurality of instructions to monitor occurrences of winning outcomes of at least one other player of other wagering games;

(b) causing the at least one processor to execute the plurality of instructions to monitor occurrences of losing outcomes of the at least one other player of the other wagering games;

(c) causing the at least one processor to execute the plurality of instructions to monitor occurrences of winning payout amounts of the at least one other player of the other wagering games;

(d) causing the at least one processor to execute the plurality of instructions to monitor a winning outcome percentage of the at least one player of the other wagering games;

(e) causing the at least one processor to execute the plurality of instructions to monitor a losing outcome percentage of the at least one player of the other wagering games;

(f) causing the at least one processor to execute the plurality of instructions to monitor a ratio of winning outcomes to losing outcomes, over a finite period of time, for a second player, the second player playing on a gaming device different from that of the first player;

(g) causing the at least one processor to execute the plurality of instructions to monitor a ratio of winning outcomes to losing outcomes, over a predetermined number of game plays, for the second player;

(h) causing the at least one processor to execute the plurality of instructions to monitor a number representing consecutive winning outcomes for the second player;

(i) causing the at least one processor to execute the plurality of instructions to monitor a number representing consecutive losing outcomes for the second player; and (j) causing the at least one processor to execute the plurality of instructions to monitor a number representing a difference between an amount wagered and an amount paid for the second player.

16. The method of claim 13, wherein causing the at least one processor to execute the plurality of instructions to monitor wagering game activity to determine if the at least one condition has been met includes causing the at least one processor to execute the plurality of instructions to monitor the outcomes of the plays of the wagering games of the first series.

17. The method of claim 13, wherein causing the at least one processor to execute the plurality of instructions to monitor wagering game activity to determine whether the at least one condition has been met includes at least one of:

(a) causing the at least one processor to execute the plurality of instructions to monitor a ratio of winning outcomes to losing outcomes, over a finite period of time, for the first player;

(b) causing the at least one processor to execute the plurality of instructions to monitor a ratio of winning outcomes to losing outcomes, over a predetermined number of game plays, for the first player;

(c) causing the at least one processor to execute the plurality of instructions to monitor a number representing consecutive winning outcomes for the first player;

(d) causing the at least one processor to execute the plurality of instructions to monitor a number representing consecutive losing outcomes for the first player; and (e) causing the at least one processor to execute the plurality of instructions to monitor a number representing a difference between an amount wagered and an amount paid for the first player.

18. The method of claim 13, which is provided through a data network.

19. The method of claim 18, wherein the data network is an internet.

20. A gaming system comprising:

at least one processor;

at least one display device;

at least one input device; and at least one memory device storing a plurality of instructions which, when executed by the at least one processor, cause the at least one processor to operate with the at least one display device and the at least one input device to:

(a) receive an indication of a first series of wagering games of a plurality of different wagering games from a first player of a gaming device, the first series of wagering games including a first quantity of at least two of the plurality of wagering games and having a respective first play order;

(b) select a second different series of wagering games of the plurality of wagering games, the second different series of wagering games including a second quantity of at least two wagering games and having a second play order;

(c) receive a first wager from the first player, the first wager being associated with play of the first series of wagering games;

(d) after receiving the first wager, enable the first player to play the wagering games of the first series of wagering games in the first play order;

(e) during play of the wagering games of the first series of wagering games:

(i) display an outcome for each played wagering game of the first series of wagering games, and (ii) monitor wagering game activity to determine whether at least one condition has been met; and (f) if the at least one condition has been met:

(i) receive a second wager from the first player; and (ii) after receiving the second wager from the first player, enable the first player to play the wagering games of the second series of wagering games in the second play order.

21. The gaming system of claim 20, wherein the plurality of instructions, when executed by the at least one processor, cause the at least one processor to monitor wagering game activity to determine whether the at least one condition has been met by monitoring other wagering game activity.

22. The gaming system of claim 21, wherein monitoring other wagering game activity includes at least one of:

(a) monitoring occurrences of winning outcomes of at least one other player of other wagering games;

(b) monitoring occurrences of losing outcomes of the at least one other player of the other wagering games;

(c) monitoring occurrences of winning payout amounts of the at least one other player of the other wagering games;

(d) monitoring a winning outcome percentage of the at least one player of the other wagering games;

(e) monitoring a losing outcome percentage of the at least one player of the other wagering games;

(f) monitoring a ratio of winning outcomes to losing outcomes, over a finite period of time, for a second player, the second player playing on a gaming device different from that of the first player;

(g) monitoring a ratio of winning outcomes to losing outcomes, over a predetermined number of game plays, for the second player;

(h) monitoring a number representing consecutive winning outcomes for the second player;

(i) monitoring a number representing consecutive losing outcomes for the second player; and (j) monitoring a number representing a difference between an amount wagered and an amount paid for the second player.

23. The gaming system of claim 20, wherein the plurality of instructions, when executed by the at least one processor, cause the at least one processor to monitor wagering game activity to determine whether at least one condition has been met by monitoring outcomes of the plays of the wagering games of the first series.

24. The gaming system of claim 20, wherein monitoring outcomes of the plays of the wagering games of the first series includes at least one of:

(a) monitoring a ratio of winning outcomes to losing outcomes, over a finite period of time, for the first player;

(b) monitoring a ratio of winning outcomes to losing outcomes, over a predetermined number of game plays, for the first player;

(c) monitoring a number representing consecutive winning outcomes for the first player;

(d) monitoring a number representing consecutive losing outcomes for the first player; and (e) monitoring a number representing a difference between an amount wagered and an amount paid for the first player.

* * * * *